US011378051B2

(12) United States Patent
Irie

(10) Patent No.: US 11,378,051 B2
(45) Date of Patent: Jul. 5, 2022

(54) IGNITION CONTROL DEVICE

(71) Applicant: DENSO CORPORATION, Kariya (JP)

(72) Inventor: Masashi Irie, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/495,167

(22) Filed: Oct. 6, 2021

(65) Prior Publication Data

US 2022/0025840 A1 Jan. 27, 2022

Related U.S. Application Data

(63) Continuation of application No. PCT/JP2020/007586, filed on Feb. 26, 2020.

(30) Foreign Application Priority Data

Apr. 9, 2019 (JP) ..... JP2019-073861

(51) Int. Cl.

| | |
|---|---|
| ***F02P 3/04*** | (2006.01) |
| ***F02P 5/15*** | (2006.01) |
| ***F02P 3/05*** | (2006.01) |
| ***F02P 15/10*** | (2006.01) |
| ***F02P 3/00*** | (2006.01) |

(52) U.S. Cl.

CPC ..... *F02P 3/04* (2013.01); *F02P 3/00* (2013.01); *F02P 3/05* (2013.01); *F02P 5/1502* (2013.01); *F02P 15/10* (2013.01)

(58) Field of Classification Search

CPC .... F02P 3/00; F02P 3/04; F02P 3/0442; F02P 3/05; F02P 5/1502; F02P 9/002; F02P 15/10

See application file for complete search history.

(56) References Cited

U.S. PATENT DOCUMENTS

2007/0267004 A1* 11/2007 Yamauchi ..... F02P 3/0892 123/604
2010/0307468 A1* 12/2010 Puettmann ..... F02P 15/10 123/636
2011/0144881 A1* 6/2011 Glugla ..... F02P 15/08 701/102

(Continued)

FOREIGN PATENT DOCUMENTS

EP 2290223 A1 * 3/2011 ..... F02P 15/10
JP 06193534 A * 7/1994 ..... F02P 15/10
JP 2017-210965 11/2017

*Primary Examiner* — John M Zaleskas
(74) *Attorney, Agent, or Firm* — Nixon & Vanderhye P.C.

(57) ABSTRACT

An ignition control device includes an ignition coil, a main ignition circuit unit for performing a main ignition operation, and an energy input circuit unit for performing an energy input operation. A main ignition signal generation circuit generates a main ignition signal such that a point in time when a waiting time has passed from a detection start time of a first signal of an ignition control signal at which a signal level of the ignition control signal changed from a first level to a second level for the first time, and the signal level of the ignition control signal is the second level, is a start of the main ignition signal, and a detection end time of a second signal of the ignition control signal at which the signal level of the ignition control signal shifts to the first level thereafter is an end of the main ignition signal.

10 Claims, 29 Drawing Sheets

(56) References Cited

U.S. PATENT DOCUMENTS

| | | | | |
|---|---|---|---|---|
| 2011/0270506 | A1* | 11/2011 | Maier | F02P 3/051 701/102 |
| 2014/0360476 | A1* | 12/2014 | Huberts | F02P 3/04 315/220 |
| 2016/0061177 | A1* | 3/2016 | Ishitani | F02P 15/10 123/623 |
| 2017/0022957 | A1* | 1/2017 | Hayashi | F02P 15/08 |
| 2017/0022960 | A1* | 1/2017 | Takeda | F02P 9/007 |
| 2017/0030318 | A1* | 2/2017 | Nakamura | F02P 9/007 |
| 2017/0045025 | A1* | 2/2017 | Nakayama | F02P 15/10 |
| 2017/0058855 | A1* | 3/2017 | Nakamura | F02P 15/10 |
| 2017/0117078 | A1* | 4/2017 | Kyouda | F02P 15/10 |
| 2017/0122281 | A1* | 5/2017 | Imanaka | F02P 17/12 |
| 2017/0159634 | A1* | 6/2017 | Fujimoto | F02D 41/3005 |
| 2018/0119666 | A1* | 5/2018 | Nakamura | F02P 5/1502 |
| 2018/0195485 | A1* | 7/2018 | Seimiya | F02P 15/10 |
| 2018/0358782 | A1* | 12/2018 | Miyake | F02P 15/10 |
| 2019/0120198 | A1* | 4/2019 | Miyake | F02P 15/10 |
| 2020/0049120 | A1 | 2/2020 | Ohno | |
| 2021/0079880 | A1* | 3/2021 | Terada | F02P 3/0453 |
| 2021/0079881 | A1* | 3/2021 | Terada | F02P 3/05 |

* cited by examiner

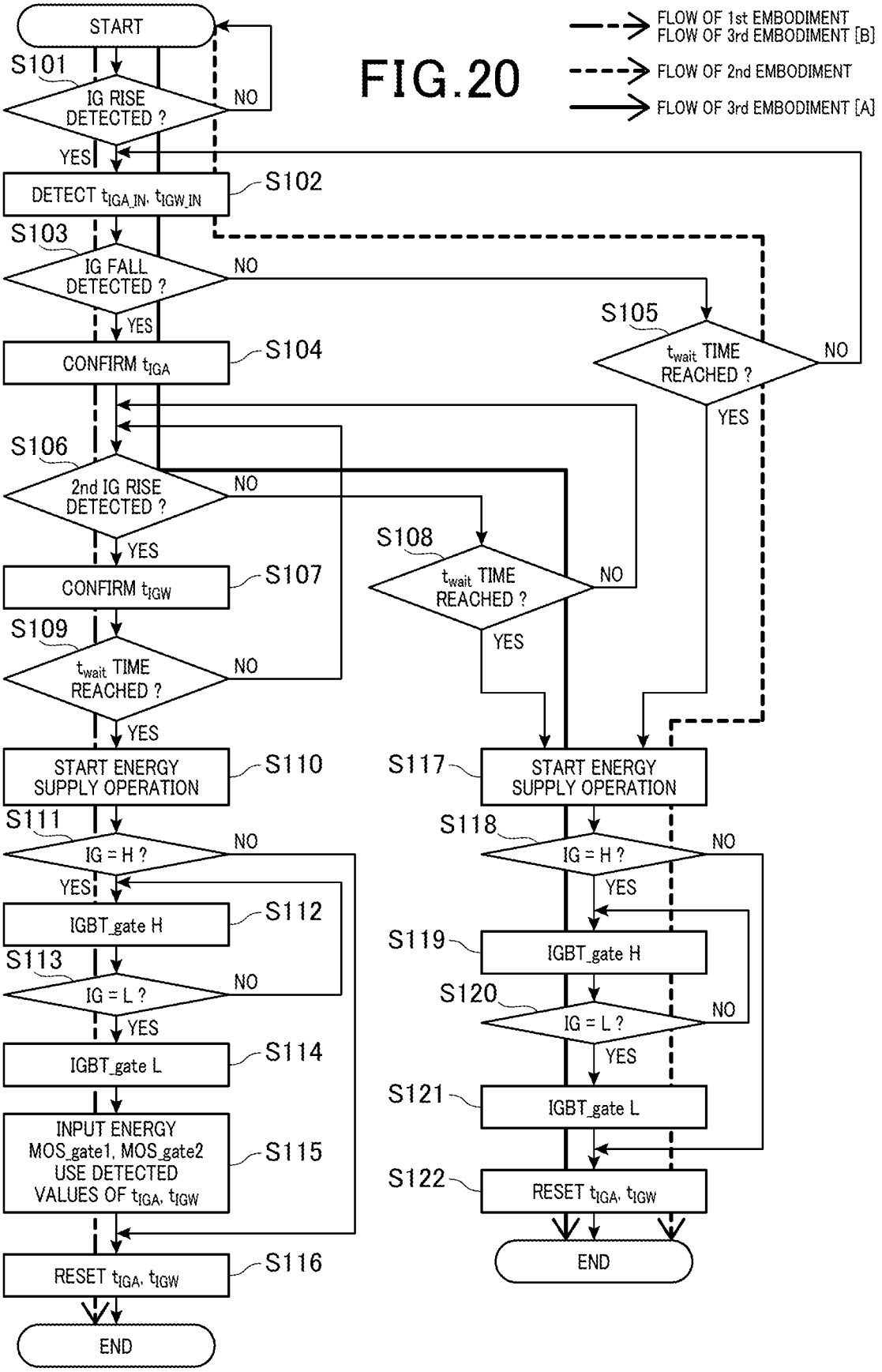
FIG.20
FLOW OF 1st EMBODIMENT
FLOW OF 3rd EMBODIMENT [B]
FLOW OF 2nd EMBODIMENT
FLOW OF 3rd EMBODIMENT [A]
START
S101
IG RISE DETECTED ?
NO
YES
DETECT $t_{IGA_IN}$, $t_{IGW_IN}$
S102
S103
IG FALL DETECTED ?
NO
YES
CONFIRM $t_{IGA}$
S104
S105
$t_{wait}$ TIME REACHED ?
NO
YES
S106
2nd IG RISE DETECTED ?
NO
YES
CONFIRM $t_{IGW}$
S107
S108
$t_{wait}$ TIME REACHED ?
NO
YES
S109
$t_{wait}$ TIME REACHED ?
NO
YES
START ENERGY SUPPLY OPERATION
S110
S117
START ENERGY SUPPLY OPERATION
S111
IG = H ?
NO
YES
IGBT_gate H
S112
S118
IG = H ?
NO
YES
S119
IGBT_gate H
S113
IG = L ?
NO
YES
IGBT_gate L
S114
S120
IG = L ?
NO
YES
S121
IGBT_gate L
INPUT ENERGY MOS_gate1, MOS_gate2 USE DETECTED VALUES OF $t_{IGA}$, $t_{IGW}$
S115
S122
RESET $t_{IGA}$, $t_{IGW}$
RESET $t_{IGA}$, $t_{IGW}$
S116
END
END

IGNITION CONTROL DEVICE

CROSS-REFERENCE TO RELATED APPLICATION

This application is a continuation application of International Application No. PCT/JP2020/007586 filed on Feb. 26, 2020 which designated the U.S. and claims priority to Japanese Patent Application No. 2019-073861 filed on Apr. 9, 2019, the contents of each of which are incorporated herein by reference.

BACKGROUND

Technical Field

The present invention relates to an ignition control device for controlling ignition of an internal combustion engine or the like.

Related Art

An ignition control device for a spark-ignition vehicle engine includes an ignition device in which a spark plug is provided for each cylinder and each spark plug is connected to an ignition coil having a primary coil and a secondary coil. The high voltage generated in the secondary coil when the energization of the primary coil is interrupted is applied to generate a spark discharge. Further, in order to facilitate ignition of the air-fuel mixture by the spark discharge, a means for supplying discharge energy after starting the spark discharge is provided.

Although it is possible to perform ignition multiple times by repeating the ignition operation by one ignition coil to achieve this, in order to perform more stable ignition control, discharge energy may be added while the spark discharge is being generated by the main ignition operation so that the secondary current is increased in a superimposed manner. In a known ignition device, two systems of energy supply means are provided for each cylinder. After starting the main ignition using the energy supply means of one of the systems, the energy supply means of the other system is operated to continuously supply a secondary current in the same direction through the secondary coil so that the spark discharge continues.

BRIEF DESCRIPTION OF THE DRAWINGS

In the accompanying drawings:

FIG. 20 is a flowchart comparing the processes of the main ignition operation and the energy input operation based on FIG. 19 according to the fifth embodiment between the first to third embodiments;

DESCRIPTION OF SPECIFIC EMBODIMENTS

Figure 1:
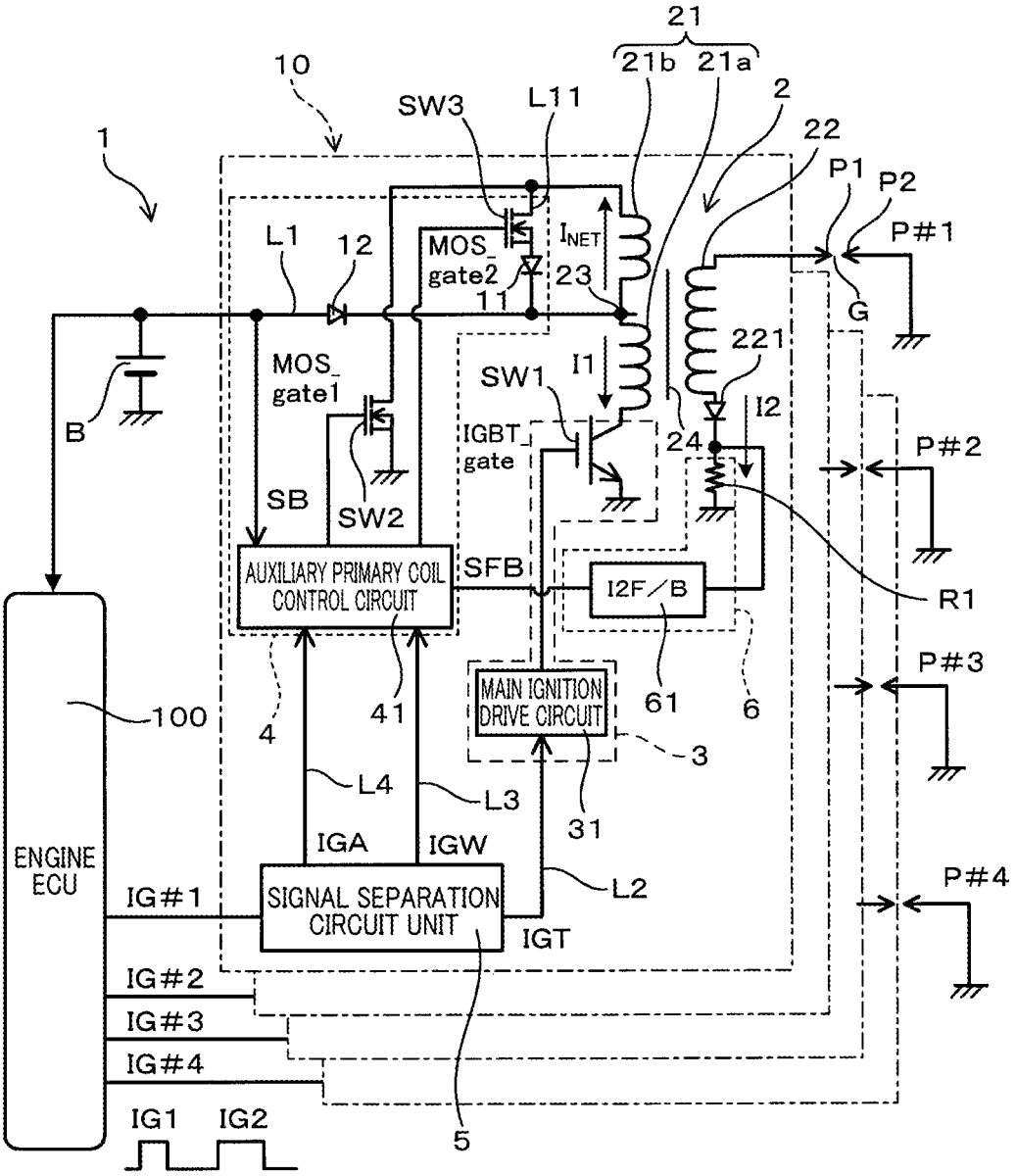
FIG. 1 is a circuit configuration diagram of an ignition control device according to the first embodiment.

The known ignition device, as disclosed in JP A-2017-210965, has two systems of energy supply means, the main ignition circuit and the energy input circuit, and a shared signal line is provided in one of the systems in order to prevent problems such as insufficient number of output terminals on the control side. One end of the shared signal line is connected to an output terminal on the control side, and the other end is branched in the middle. Each of the branches is connected to an energy input circuit provided for each cylinder. This configuration makes it possible to control the energy input of a plurality of cylinders by adding one signal line.

The configuration of the ignition device disclosed in JP A-2017-210965 includes a branch connector and a branch line for each cylinder for branching the shared signal line therein. Therefore, as the number of cylinders increases, the wiring becomes complicated, which makes it necessary to increase the size of the branching part in order to ensure the reliability of the branching part, resulting in an increased size. Further, since a plurality of signals for at least main ignition and energy input are transmitted, noise and the like may be generated by inputting signals during the ignition operation, and it may be necessary to take measures such as applying a noise filter to avoid its influence.

Therefore, it is desired to simplify the system configuration by further integrating the signal lines connecting the devices to reduce the number of connector terminals and connection ports, and reducing the effects such as that of signal transmission on the ignition operation to eliminate the need for means such as a noise filter.

In view of the foregoing, it is desired to have a compact and high-performance ignition control device capable of transmitting and receiving signals for performing the main ignition operation and the energy input operation using fewer signal lines.

One aspect of the present disclosure provides an ignition control device including: an ignition coil which generates discharge energy in a secondary coil connected to a spark plug by increasing and decreasing a primary current flowing through a primary coil; a main ignition circuit unit which controls energization of the primary coil to perform a main ignition operation for causing the spark plug to generate a spark discharge; and an energy input circuit unit which performs an energy input operation for superimposing a current of the same polarity on a secondary current caused to flow through the secondary coil by the main ignition operation. In the ignition control device, the ignition control device further comprises a signal separation circuit unit which receives an ignition control signal which is a signal combining a main ignition signal for controlling the main ignition operation, an energy input signal for controlling the energy input operation, and a target secondary current instruction signal, and separates one or more signals included in the received ignition control signal. The signal separation circuit unit generates the main ignition signal such that a point in time when a waiting time has passed from when a signal level of the ignition control signal changed from a first level to a second level for the first time, and the signal level of the ignition control signal is the second level, is a start of the main ignition signal, and a point in time at which the signal level of the ignition control signal shifts to the first level thereafter is an end of the main ignition signal. The main ignition circuit unit energizes the primary coil at the start of the main ignition signal and cuts off the energization of the primary coil at the end of the main ignition signal.

The ignition control signal received by the signal separation circuit unit of the ignition control device includes information for three signals, namely, the main ignition signal, the energy input signal, and the target secondary current instruction signal, and it can be separated into the individual signals based on the signal waveform. For example, the main ignition signal is generated with a start condition that the signal level is the second level when a predetermined waiting time has passed after the signal level first changes from the first level to the second level, and an end condition that the signal level shift to the first level thereafter. The main ignition circuit unit performs an operation for energizing the primary coil based on the generated main ignition signal, and performs the main ignition operation. In case the energy input operation is to be performed following the main ignition operation, the energy input signal and the target secondary current instruction signal are also generated by being separated in the signal separation circuit unit.

Since a plurality of signals for main ignition and energy input can be combined into one ignition control signal and transmitted on one signal line, there is no need to provide a plurality of signal lines for each cylinder, or branch a shared line. Further, since the signal for the energy input operation can be transmitted before the start of the main ignition operation, the energization operation for the main ignition is less likely to be affected by noise. Therefore, efficient ignition control can be achieved with reduced numbers of wires, connectors, and connection ports and without complicating the system configuration or increasing the size.

Thus, according to the above-described aspect, it is possible to provide a compact and high-performance ignition control device capable of transmitting and receiving signals for performing the main ignition operation and the energy input operation using fewer signal lines.

First Embodiment

A first embodiment according to the ignition control device will be described with reference to FIGS. 1 to 14.

In FIG. 1, the ignition control device 1 is applied to, for example, an internal combustion engine such as a vehicle spark-ignition engine to control the ignition of the spark plugs P which are each attached to a corresponding cylinder. The ignition control device 1 includes an ignition device 10 provided with an ignition coil 2, a main ignition circuit unit 3, an energy input circuit unit 4, and a signal separation circuit unit 5, and an engine electronic control device (hereinafter, abbreviated as engine ECU; Electronic Control Unit) 100 as an ignition control signal transmission unit configured to give ignition instructions to the ignition device 10

The ignition coil 2 generates discharge energy in the secondary coil 22 connected to the spark plug P by increasing and decreasing the primary current I1 flowing through the primary coil 21. The main ignition circuit unit 3 controls the energization of the primary coil 21 of the ignition coil 2 to perform a main ignition operation for causing the spark plug P to generate a spark discharge. The energy input circuit unit 4 performs an energy input operation for superimposing a current of the same polarity on the secondary current I2 flowing through the secondary coil 22 by the main ignition operation.

The primary coil 21 includes, for example, a main primary coil 21*a* and an auxiliary primary coil 21*b*, and the energy input circuit unit 4 can control the energy input operation by controlling the energization of the auxiliary primary coil 21*b*.

The signal separation circuit unit 5 receives an ignition control signal IG from the engine ECU 100 and separates a signal included in the ignition control signal IG. The ignition control signal IG is a signal combining a main ignition signal IGT for controlling the main ignition operation, an energy input signal IGW for controlling the energy input operation, and a target secondary current instruction signal IGA, and is received as, for example, one pulse signal or a combination of two signals. The ignition control signal IG is separated into individual signals again in the signal separation circuit unit 5. For example, the main ignition signal IGT is generated by separating it from the ignition control signal to enable the main ignition operation.

Figure 2:
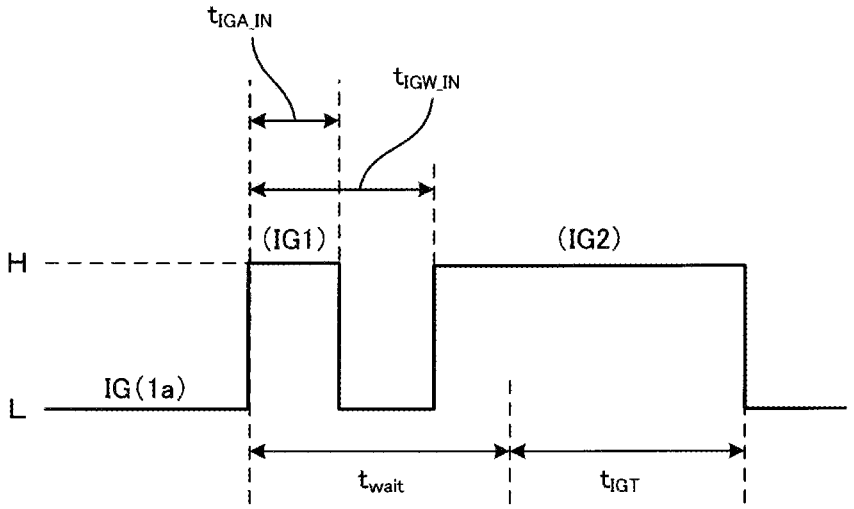
FIG. 2 is a waveform diagram of an ignition control signal received by the ignition control device according to the first embodiment.

At this time, the signal separation circuit unit 5 generates the main ignition signal IGT based on the signal level of the ignition control signal IG. Specifically, as shown in FIG. 2, when a waiting time $t_{wait}$ has passed from when the signal level changed from the first level (for example, the L level) to the second level (for example, the H level) for the first time, and the signal level of the ignition control signal IG is the second level (for example, the H level), that point in time is the start of the main ignition signal IGT, and when the signal level of the ignition control signal IG reaches the first level (for example, the L level) after that, that point in time is the end of the main ignition signal IGT.

The waiting time $t_{wait}$ is a preset time for generating the main ignition signal IGT from the ignition control signal IG, and as will be described later, it corresponds to the time period from the switching (for example, rising) of the signal level of the ignition control signal IG to the switching (for example, rising) of the signal level of the main ignition signal IGT.

In accordance with this, the main ignition operation is performed in the main ignition circuit unit 3 in which the primary coil 21 is energized at the start of the main ignition signal IGT and the energization of the primary coil 21 is cut off at the end of the main ignition signal IGT. Note that the signal level of the ignition control signal IG is represented by two voltage levels, the H level and L level. When the voltage is equal to or higher than a preset threshold voltage, the level becomes the H level, and when it is below the threshold voltage, the level becomes the L level. In the present embodiment, it will be assumed below that the first level corresponds to the L level and the second level corresponds to the H level.

In the present embodiment, the ignition control signal IG is generated as a signal composed of a first pulse signal IG1 and a second pulse signal IG2. The engine ECU 100 generates an ignition control signal IG that combines these two signals IG1 and IG2 every combustion cycle (for example, 720° CA) and transmits it to the signal separation circuit unit 5 prior to the main ignition operation.

The first signal IG1 and the second signal IG2 of the ignition control signal IG are distinguished from each other by, for example, assuming that the first input signal input from the engine ECU 100 to the ignition device 10 after the operation of the ignition control device 1 has been started is the first signal IG1, and the next input signal is the second signal IG2. The subsequent input signals can also be identified by performing the same operation repeatedly.

Figure 3:
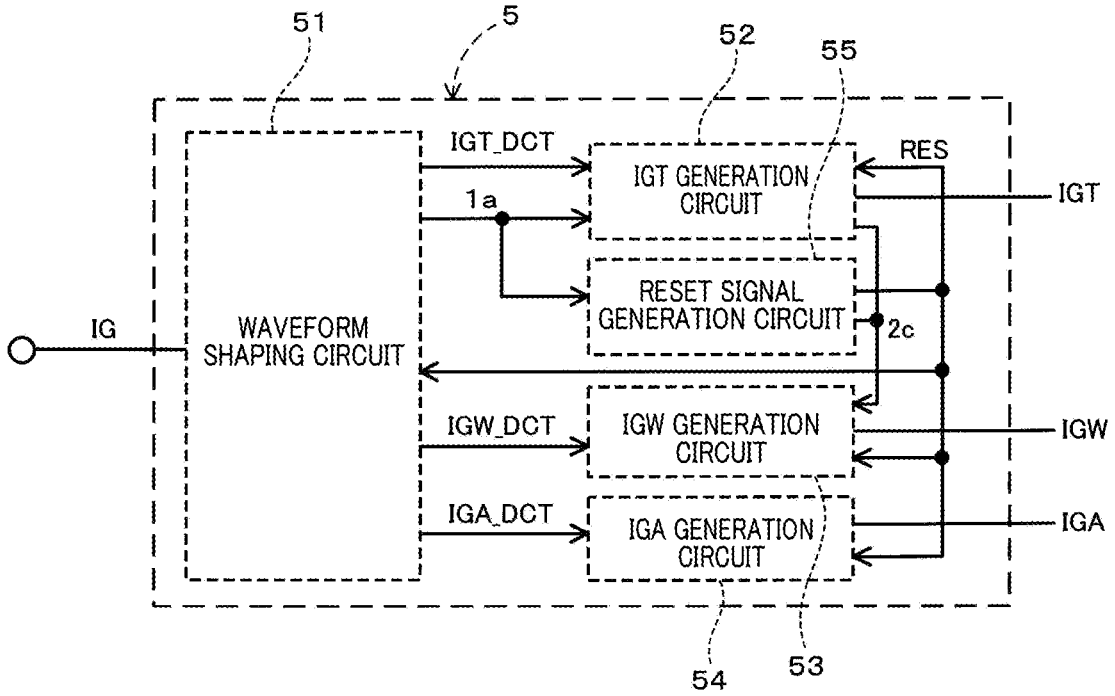
FIG. 3 is a circuit configuration diagram of a signal separation circuit unit forming a part of an ignition device of the ignition control device according to the first embodiment.

In that case, as shown in FIG. 3, the signal separation circuit unit 5 includes circuits for receiving the ignition control signal IG and separating the received ignition control signal IG into 3 signals included in the ignition control signal IG.

Figure 4:
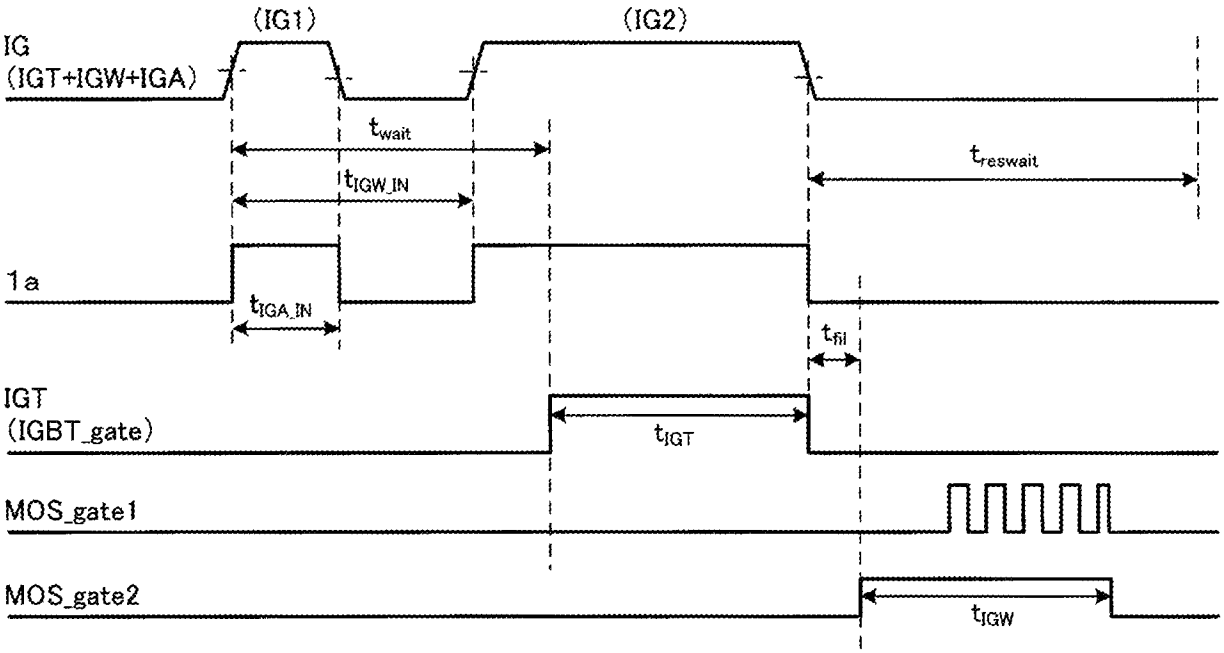
FIG. 4 is a timing chart diagram showing the relationship between the ignition control signal and the gate signals for main ignition and energy input according to the first embodiment.

Specifically, as shown in FIG. 4, it includes a main ignition signal generation circuit (hereinafter, referred to as an IGT generation circuit) 52 which, when the waiting time $t_{wait}$ has elapsed from the detection start time (that is, rising) of the first signal IG1, and the signal level of the second signal IG2 is the second level (that is, the H level), starts generating the main ignition signal IGT at that time and terminates it at the detection end time (that is, falling) of the second signal IG2. The IGT generation circuit 52 may include a circuit for generating the waiting time $t_{wait}$.

Further, the signal separation circuit unit 5 generates the energy input signal IGW based on the pulse waveform information of the first signal IG1 and the second signal IG2, and the target secondary current instruction signal IGA can be generated based on the pulse waveform information of the first signal IG1. The pulse waveform information is information such as the time period or interval determined based on the rising or falling of one or more pulses, and it includes the time period of the rising or falling of a pulse, an interval between the rising or falling of a pulse and the rising or falling of another pulse, and the like.

In this embodiment, for example, an energy input signal generation circuit (hereinafter, referred to as an IGW generation circuit) 53 is provided which generates the energy input signal IGW based on the rising interval $t_{IGW_IN}$ as a detection interval between the first signal IG1 and the second signal IG2. Further, a target secondary current instruction signal generation circuit (hereinafter referred to as an IGA generation circuit) 54 may be provided which generates the target secondary current instruction signal IGA based on the rising period $t_{IGA_IN}$ as a detection period of the first signal IG1.

The ignition control device 1 operates the main ignition circuit unit 3 based on the main ignition signal IGT to perform the main ignition operation. Further, after the main ignition, it operates the energy input circuit unit 4 based on the energy input signal IGW to perform the energy input operation and make the spark discharge continue. The energy input for this continuous discharge is indicated by the target secondary current instruction signal IGA. The ignition control device 1 further includes a feedback control unit 6 configured to feedback-control the secondary current I2. The feedback control unit 6 feedback-controls the secondary current I2 flowing through the secondary coil 22 of the ignition coil 2 based on the target secondary current instruction signal IGA so that it reaches the target secondary current value I2*tgt*.

Next, the configuration of the ignition control device 1 will be described in detail.

The engine to which the ignition control device 1 of the present embodiment is applied is, for example, a 4-cylinder engine. A spark plugs P is for provided each cylinder (for example, represented by P #1 to P #4 in FIG. 1), and an ignition device 10 is provided for each spark plug P. The ignition control signal IG is transmitted from the engine ECU 100 to each ignition device 10.

Each spark plug P has a known configuration including a center electrode P1 and a ground electrode P2 facing each other, and the space formed between the leading ends of the two electrodes serves as a spark gap G. The discharge energy generated in the ignition coil 2 based on the ignition control signal IG is supplied to the spark plug P so that a spark discharge is generated in the spark gap G, which ignites the air-fuel mixture in the engine combustion chamber (not shown). The energization of the ignition coil 2 is controlled based on the main ignition signal IGT, the energy input signal IGW, and the target secondary current instruction signal IGA included in the ignition control signal IG.

In the ignition coil 2, the main primary coil 21*a* or the auxiliary primary coil 21*b* serving as the primary coil 21 and the secondary coil 22 are magnetically coupled to each other to form a known step-up transformer. One end of the secondary coil 22 is connected to the center electrode P1 of the spark plug P, and the other end is grounded via a first diode 221 and a secondary current detection resistor R1. The first diode 221 is placed so that its anode terminal is connected to the secondary coil 22 and its cathode terminal is connected to the secondary current detection resistor R1 so as to regulate the direction of the secondary current I2 flowing through the secondary coil 22. The secondary current detection resistor R1 constitutes a feedback control unit 6 together with a secondary current feedback circuit (for example, represented by I2F/B in FIG. 1) 61, which will be described in detail later.

The main primary coil 21*a* and the auxiliary primary coil 21*b* are connected in series with each other and are connected in parallel to a DC power source B such as a vehicle battery. Specifically, an intermediate tap 23 is provided between one end of the main primary coil 21*a* and one end of the auxiliary primary coil 21*b*, and a power supply line L1 leading to the DC power source B is connected to the intermediate tap 23. The other end of the main primary coil 21*a* is grounded via a switching element for main ignition (hereinafter, abbreviated as main ignition switch) SW1, and the other end of the auxiliary primary coil 21*b* is grounded via a switching element for making the discharge continue (hereinafter, abbreviated as discharge continuation switch) SW2.

Thus, the battery voltage can be applied to the primary coil 21*a* or the auxiliary primary coil 21*b* when the main ignition switch SW1 or the discharge continuation switch SW2 is on. The main ignition switch SW1 is a part of the main ignition circuit unit 3, and the discharge continuation switch SW2 is a part of the energy input circuit unit 4.

The ignition coil 2 is integrally formed by winding the primary coil 21 and the secondary coil 22 around, for example, a bobbin for the primary coil and a bobbin for the secondary coil placed around a core 24. By having a sufficiently large turn ratio, which is the ratio of the number of turns of the main primary coil 21*a* or the auxiliary primary coil 21*b*, which is the primary coil 21, to the number of turns of the secondary coil 22, a high voltage corresponding to the turn ratio can be generated in the secondary coil 22. The main primary coil 21*a* and the auxiliary primary coil 21*b* are wound so that the directions of the magnetic flux they generate when energized by the DC power source B are opposite to each other, and the number of turns of the auxiliary primary coil 21*b* is smaller than that of the main primary coil 21*a*.

As a result, after generating a discharge in the spark gap G of the spark plug P by the voltage generated by interrupting the energization of the main primary coil 21*a*, a superimposed magnetic flux having the same direction can be generated by energizing the auxiliary primary coil 21*b* which increases the discharge energy in a superimposed manner.

The main ignition circuit unit 3 includes the main ignition switch SW1 and a switch drive circuit for main ignition operation 31 configured to drive the main ignition switch SW1 on and off (hereinafter, referred to as a main ignition drive circuit). The main ignition switch SW1 is a voltage-driven switching element, for example, an IGBT (that is, an insulated gate bipolar transistor). The conduction between the collector terminal and the emitter terminal is established or cut off by controlling the gate potential through a gate signal IGBT_gate input to the gate terminal. The collector terminal of the main ignition switch SW1 is connected to the other end of the main primary coil 21*a*, and its emitter terminal is grounded.

The main ignition signal IGT output from the signal separation circuit unit 5 is input to the input terminal of the main ignition drive circuit 31 via an output signal line L2. The main ignition drive circuit 31 drives the main ignition switch SW1 in response to the main ignition signal IGT.

The main ignition drive circuit 31 (see, for example, FIG. 4) generates a gate signal IGBT_gate corresponding to the main ignition signal IGT to turn the main ignition switch SW1 on or off at a certain timing.

Specifically (see, for example, FIG. 5), when the main ignition switch SW1 is turned on at the time the main ignition signal IGT rises, energization of the main primary coil 21*a* is started and the primary current I1 flows. Next, when the main ignition switch SW1 is turned off at the time the main ignition signal IGT falls, the energization of the main primary coil 21*a* is cut off, and a high voltage is generated in the secondary coil 22 by mutual induction. This high voltage is applied to the spark gap G of the spark plug P to generate a spark discharge, and the secondary current I2 flows.

The rising period $t_{IGT}$ (that is, the period from the rising to falling) of the main ignition signal IGT is appropriately set, for example, so that the primary current I1 has a predetermined value when the energization of the primary coil 21 is cut off.

The energy input circuit unit 4 includes the discharge continuation switch SW2 and a auxiliary primary coil control circuit 41 that outputs a drive signal for driving the discharge continuation switch SW2 on and off to control energization of the auxiliary primary coil 21*b*. Further, a switching element (hereinafter, abbreviated as a flyback switch) SW3 is provided to open and close a flyback path L11 connected to the auxiliary primary coil 21*b*. The on/off operation is carried out by a drive signal from the auxiliary primary coil control circuit 41.

The discharge continuation switch SW2 and the flyback switch SW3 are voltage-driven switching elements, for example, MOSFETs (that is, field effect transistors). The conduction between the drain terminal and the source terminal is established or cut off by controlling the gate potential through a gate signal MOS_gate1, MOS_gate2 input to the gate terminal. The drain terminal of the discharge continuation switch SW2 is connected to the other end of the auxiliary primary coil 21*b*, and its source terminal is grounded.

The flyback path L11 is provided between the other end of the auxiliary primary coil 21*b* (that is, the side opposite to the main primary coil 21*a*) and the power supply line L1. The drain terminal of the flyback switch SW3 is connected to the connection point between the other end of the auxiliary primary coil 21*b* and the discharge continuation switch SW2, and its source terminal is connected to the power supply line L1 via the second diode 11. Further, in the power supply line L1, a third diode 12 is provided between its connection point with the flyback path L11 and the DC power source B. The forward direction of the second diode 11 is the direction toward the power supply line L1, and the forward direction of the third diode 12 is the direction toward the primary coil 21.

The energy input signal IGW and the target secondary current instruction signal IGA output from the signal separation circuit unit 5 are input to the input terminal of the auxiliary primary coil control circuit 41 via output signal lines L3, L4. Further, a feedback signal SFB is input to the auxiliary primary coil control circuit 41 from the secondary current feedback circuit 61 of the feedback control unit 6, and further, a battery voltage signal SB is input from the power supply line L1.

The auxiliary primary coil control circuit 41 (see, for example, FIG. 4) generates gate signals MOS_gate1, MOS_gate2 to drive the discharge continuation switch SW2 and the flyback switch SW3. The gate signal MOS_gate2 will be ON for the energy input period $t_{IGW}$ indicated by the energy input signal IGW, and the gate signal MOS_gate1 will be driven on and off to maintain the target secondary current value I2*tgt* indicated by the target secondary current instruction signal IGA (see, for example, FIG. 5).

The secondary current feedback circuit 61 outputs, for example, the detected value of the secondary current I2 based on the secondary current detection resistor R1 as the feedback signal SFB, and the auxiliary primary coil control circuit 41 drives the discharge continuation switch SW2 and the flyback switch SW3 based on the result of comparison between the detected value of the secondary current I2 and the target secondary current value I2*tgt*. At this time, it may also be determined whether the energy input operation is possible based on the battery voltage signal SB.

Specifically, when the energy input signal IGW rises after a predetermined delay period $t_{fil}$ from the falling of the main ignition signal IGT, the gate signal MOS_gate2 rises and the flyback switch SW3 is turned on. Next, when the secondary current I2 (absolute value) flowing through the secondary coil 22 due to the main ignition operation decreases and reaches the target secondary current value I2*tgt*, the gate signal MOS_gate1 rises and the discharge continuation switch SW2 is turned on. As a result, energization of the auxiliary primary coil 21*b* starts, and the current $I_{NET}$ flowing through the secondary primary coil 21*b* causes superimposition of the secondary current I2.

The target secondary current value I2*tgt* serves as a lower limit threshold (absolute value) for turning on the discharge continuation switch SW2, and it is indicated by the target secondary current instruction signal IGA. The target secondary current instruction signal IGA is a function $f(t_{IGA_IN})$ based on the rising period $t_{IGA_IN}$ of the first signal IG1, and this function is set before starting the main ignition operation. An upper limit threshold (absolute value) for turning off the discharge continuation switch SW2 is set corresponding to the lower limit threshold. Thus, when the secondary current I2 (absolute value) increases again due to the energy supply and reaches the predetermined upper limit threshold, the gate signal MOS_gate1 rises and the discharge continuation switch SW2 is turned off. In this way, the discharge continuation switch SW2 is repeatedly turned on and off according to the gate signal MOS_gate1, so that the secondary current I2 can be maintained near the target secondary current value I2*tgt*.

Since the flyback switch SW3 is turned on while the discharge continuation switch SW2 is off, the other end of the auxiliary primary coil 21*b* and the power supply line L1 are connected via the flyback path L11. Therefore, a flyback current flows when the energization of the secondary primary coil 21*b* is cut off, and the current of the auxiliary primary coil 21*b* changes slowly, so that a sudden decrease in the secondary current I2 can be suppressed.

The predetermined delay period $t_{fil}$ is appropriately set so that, for example, the energy input operation is performed after the secondary current I2 caused to flow by the main ignition operation has dropped to some extent. This is for outputting the energy input signal IGW, which indicates the period for which the energy input operation should be carried out, at a certain timing after the spark discharge has been started by the main ignition operation, which makes it possible to effectively maintain the spark discharge by the energy input.

Next, the details of the signal separation circuit unit 5 will be described with reference to FIGS. 2 to 5.

As shown in FIG. 2, the ignition control signal IG includes the first signal IG1 and the second signal IG2. The earlier signal output when the ignition control signal IG rises is the first signal IG1, and the latter signal output after the first signal IG1 has fallen is the second signal IG2.

The ignition control signal IG sets the energy input period $t_{IGW}$ by the rising interval $t_{IGW_IN}$, which is the length from the rise of the first signal IG1 to the rise of the second signal IG2. Further, it sets the target secondary current value I2*tgt* by the rising period $t_{IGA_IN}$, which is the length from the rising to falling of the first signal IG1.

Note that the period from the rise to the fall of the ignition control signal IG is the period from the rise of the first signal IG1 to the fall of the second signal IG2, and the length of this period is the sum of the length of the waiting time $t_{wait}$ and the length of the rising period $t_{IGT}$ of the main ignition signal IGT. In other words, the ignition control signal IG is output at a timing earlier than the rising of the main ignition signal IGT by the waiting time $t_{wait}$. The ignition control signal IG and the main ignition signal IGT fall at the same time, and no signal is transmitted from the engine ECU 100 after that.

In FIG. 3, the signal separation circuit unit 5 includes a waveform shaping circuit 51 for shaping the waveform of the ignition control signal IG, an IGT generation circuit 52 for generating the main ignition signal IGT, an IGW generation circuit 53 for generating the energy input signal IGW, and an IGA generation circuit 54 for generating the target secondary current instruction signal IGA. Further, a reset signal generation circuit 55 for generating a reset signal RES is provided.

Figure 5:
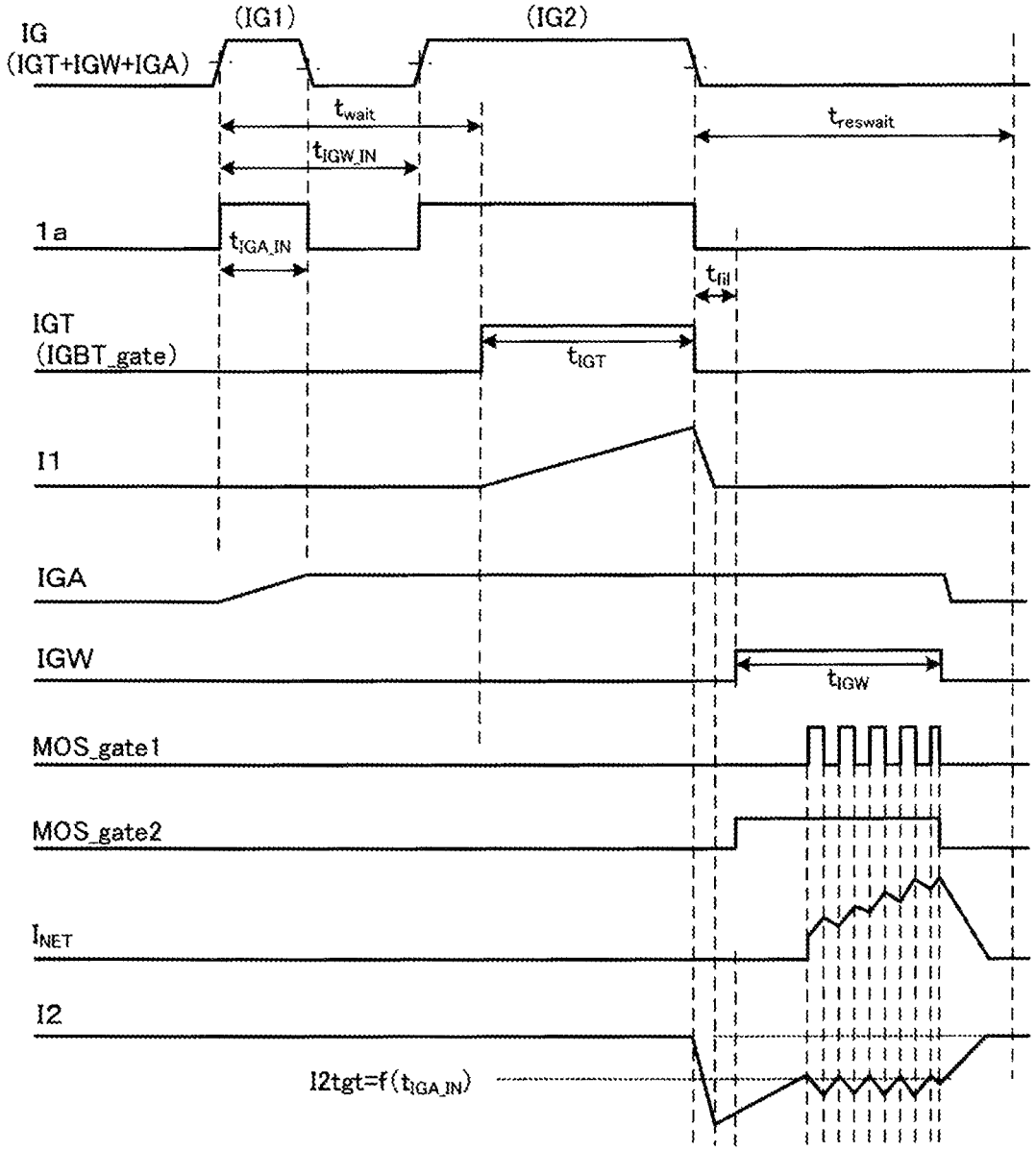
FIG. 5 is a timing chart diagram showing the processes of the main ignition operation and the energy input operation based on signals generated in the ignition control device according to the first embodiment.

As shown in FIGS. 4 and 5, the ignition control signal IG is a composite signal obtained by combining the main ignition signal IGT, the energy input signal IGW, and the target secondary current instruction signal IGA. First, filtering is performed on the ignition control signal IG in the waveform shaping circuit 51 shown in FIG. 3. As a result, it is output to the IGT generation circuit 52 and the reset signal generation circuit 55 as a square wave signal 1*a* including the first signal IG1 and the second signal IG2 each having a square waveform from which noise has been removed. The reset signal RES from the reset signal generation circuit 55 is output to the IGT generation circuit 52, the IGW generation circuit 53, and the IGA generation circuit 54.

Further, based on the square wave signal 1*a*, a signal IGT_DCT for generating the main ignition signal IGT, a signal IGW_DCT for generating the energy input signal IGW, and a signal IGT_DCT for generating the target secondary current instruction signal IGA are generated. These signals IGT_DCT, IGW_DCT, and IGA_DCT are output to the IGT generation circuit 52, the IGW generation circuit 53, and the IGA generation circuit 54, respectively.

Next, the configurations of the waveform shaping circuit 51, the IGT generation circuit 52, the IGW generation circuit 53, and the IGA generation circuit 54, which constitute the signal separation circuit unit 5, will be described with reference to FIGS. 6 to 13.

Figure 6:
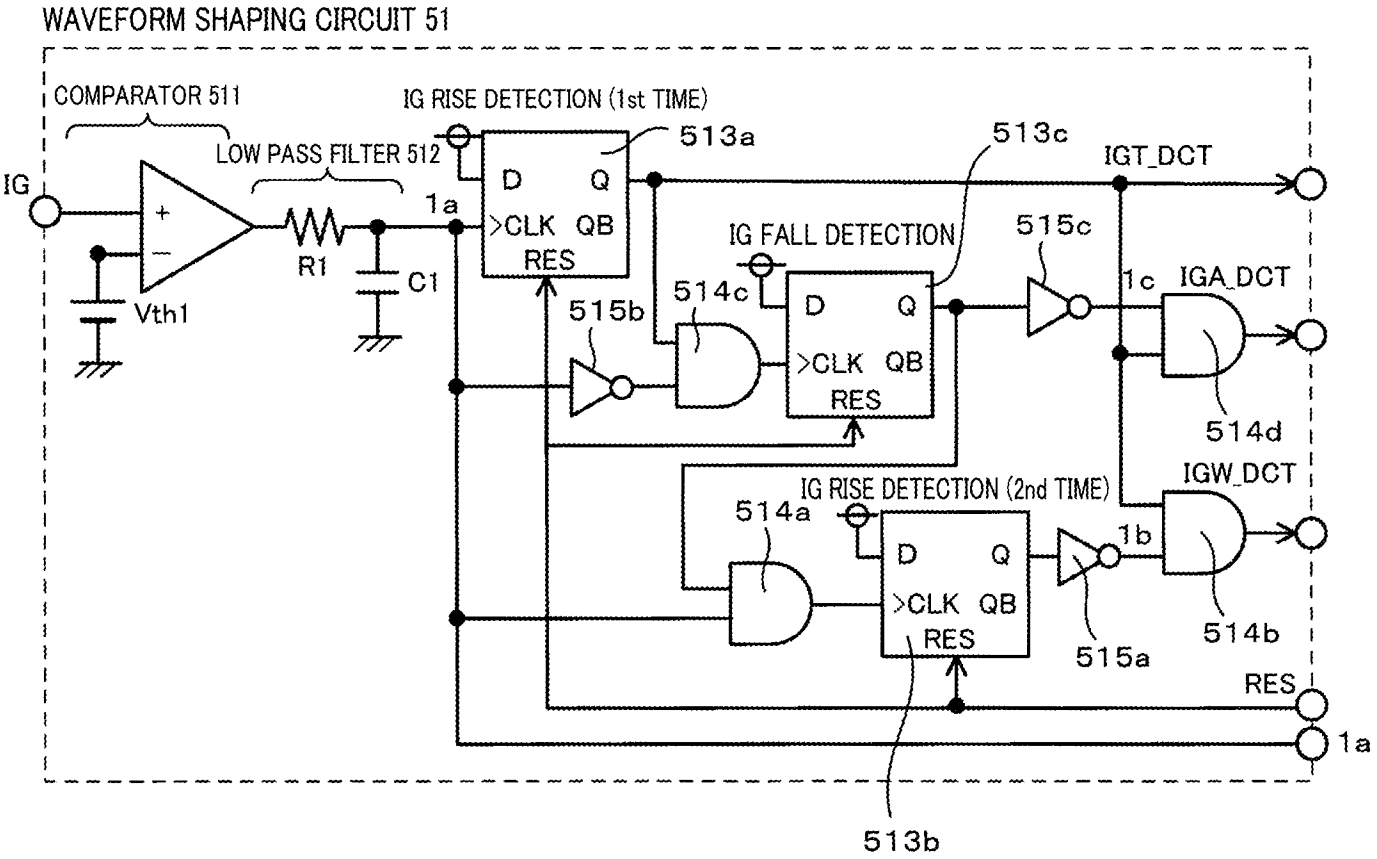
FIG. 6 is a circuit configuration diagram of a waveform shaping circuit forming a part of the ignition device according to the to the first embodiment.

As shown in FIG. 6, the waveform shaping circuit 51 includes a first comparator 511, a low-pass filter 512, first to third D flip-flops 513*a* to 513*c*, first to fourth AND circuits 514*a* to 514*d*, and first to third inverter circuits 515*a* to 515*c*.

A reference potential Vth1 serving as a threshold is applied to the negative input terminal of the first comparator 511, and when the ignition control signal IG is input to its positive input terminal, an output signal based on the result of comparison between the two is transmitted from the output terminal to the low-pass filter 512. The low-pass filter 512 has a known filter configuration including a resistor R1 and a capacitor C1.

Figure 7:
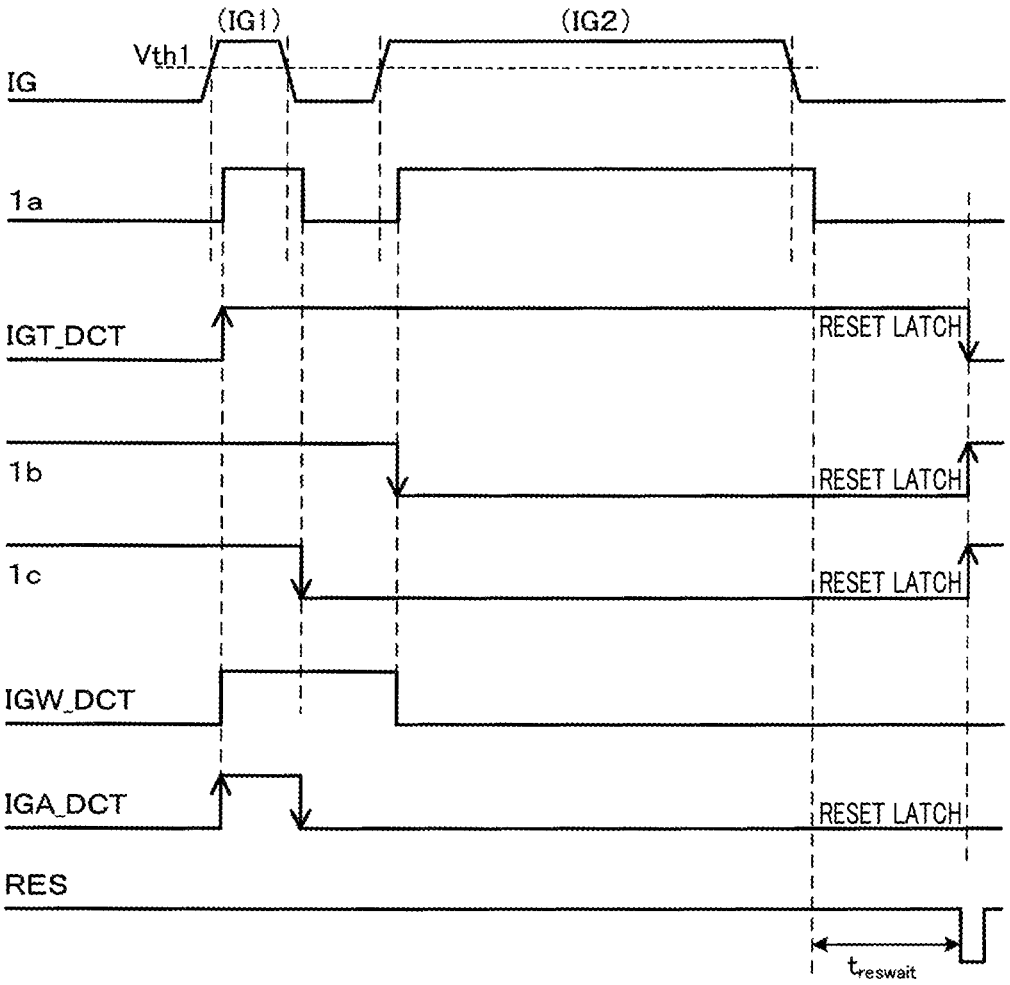
FIG. 7 is a timing chart diagram showing the relationship between the ignition control signal and the various signals generated in the waveform shaping circuit according to the first embodiment.

Thus, as shown in FIG. 7, the first comparator 511 amplifies or reduces the output according to the comparison result between the ignition control signal IG and the reference potential Vth1, and shapes the signal into an H/L binary signal. By removing the high-frequency noise by passing the signal through the low-pass filter 512, the ignition control signal IG is shaped into a square waveform having rising and falling edges (that is, the square wave signal 1*a* in the figure).

The shaped square wave signal 1*a* is input to the first D flip-flop 513*a*. The first D flip-flop 513*a* is a circuit for detecting the first rise of the ignition control signal IG and outputting it as the signal IGT_DCT. The square wave signal 1*a* is input to the clock terminal (hereinafter referred to as CLK terminal) of the first D flip-flop 513*a*, and a power supply is connected to the data terminal (hereinafter referred to as D terminal) and a potential corresponding to the H level is supplied. Thus, when the signal level of the D terminal is latched in synchronization with the rise of the square wave signal 1*a*, the signal IGT_DCT output from the output terminal (hereinafter referred to as the Q terminal) rises to the H level.

Note that a reset signal RES from the reset signal generation circuit 55 is input to the reset terminal (hereinafter referred to as the RES terminal) of the first D flip-flop 513*a*, and the latch is reset when the reset signal RES switches from the H level to the L level.

As shown in FIG. 7, the reset signal RES switches from the H level to L level when a predetermined reset period $t_{reswait}$ passes after the second fall of the square wave signal 1*a* (that is, corresponding to the fall of the second signal IG2). Accordingly, every time the ignition control signal IG is output, the signal IGT_DCT, which is a detection signal of the rise of the ignition control signal IG (that is, the rise of the first signal IG1), is output from the first D flip-flop 513*a*, and it is reset when the signal RES falls.

The second D flip-flop 513*b* has a configuration equivalent to that of the first D flip-flop 513*a*, and it is a circuit for detecting the second rise of the ignition control signal IG (that is, the rise of the second signal IG2) based on the signal input from the first AND circuit 514*a* to the CLK terminal. The output from the second D flip-flop 513*b* is input to the second AND circuit 514*b* via the first inverter circuit 515*a*, and is output as the signal IGW_DCT for detecting the first rise and the subsequent rise of the ignition control signal IG.

The third D flip-flop 513*c* has a configuration equivalent to that of the first D flip-flop 513*a*, and it is a circuit for detecting the first fall of the ignition control signal IG (that is, the fall of the first signal IG1) based on the signal input from the second AND circuit 514*b* to the CLK terminal via the second inverter circuit 515*b*. The output from the third D flip-flop 513*c* is input to the fourth AND circuit 514*d* via the third inverter circuit 515*c*, and is output as the signal IGA_DCT for detecting the first rise and the fall of the ignition control signal IG.

Note that the reset signal RES from the reset signal generation circuit 55 is also input to the RES terminals of the second D flip-flop 513*b* and the third D flip-flop 513*c* so that their latches are reset at the same timing as the first D flip-flop 513*a*.

The square wave signal 1*a* is input to one terminal of the first AND circuit 514*a*, and a signal from the Q terminal of the third D flip-flop 513*c* is input to the other terminal.

When one terminal of the first AND circuit 514*a* shifts to the H level due to the fall of the square wave signal 1*a*, and the other terminal shifts to the H level due to the second rise of the square wave signal 1*a* after that, at this timing, the first AND circuit 514*a* outputs a signal having the H level to the CLK terminal of the second D flip-flop 513*b*. As a result, the output from the Q terminal will have the H level, and this output is input to one terminal of the second AND circuit 514*b* as a signal 1*b* inverted by the first inverter circuit 515*a*.

That is, as shown in FIG. 7, the signal 1*b* is a signal that initially has the H level and shifts to the L level at the time of the second rise of the ignition control signal IG. The signal IGT_DCT from the Q terminal of the first D flip-flop 513*a* is input to the other terminal of the second AND circuit 514*b*.

At this time, the second AND circuit 514*b* outputs a signal IGW_DCT, which has the H level when the signal 1*b* is at the H level and the signal IGT_DCT is at the H level. In other words, the signal IGW_DCT is a signal that rises when the signal IGT_DCT shifts to the H level and falls when the signal 1*b* shifts to the L level.

The signal IGT_DCT from the Q terminal of the first D flip-flop 513*a* is input to one terminal of the third AND circuit 514*c*, and the square wave signal 1*a* is input to its other terminal via the second inverter circuit 515*b*.

At this time, when the signal IGT_DCT is at the H level and the square signal 1*a* is at the L level, the third AND circuit 514*c* outputs a signal having the H level to the CLK terminal of the third D flip-flop 513*c*. As a result, the output from the Q terminal will have the H level, and will be input to one terminal of the fourth AND circuit 514*d* as a signal 1*c* inverted by the third inverter circuit 515*c*.

That is, as shown in FIG. 7, the signal 1*c* is a signal that initially has the H level and shifts to the L level at the time of the first fall of the ignition control signal IG. The signal IGT_DCT from the Q terminal of the first D flip-flop 513*a* is input to the other terminal of the fourth AND circuit 514*d*.

At this time, the fourth AND circuit 514*d* outputs a signal IGA_DCT, which has the H level when the signal 1*c* is at the H level and the signal IGT_DCT is at the H level. In other words, the signal IGA_DCT is a signal that rises when the signal IGT_DCT shifts to the H level and falls when the signal 1*b* shifts to the L level.

Figure 8:
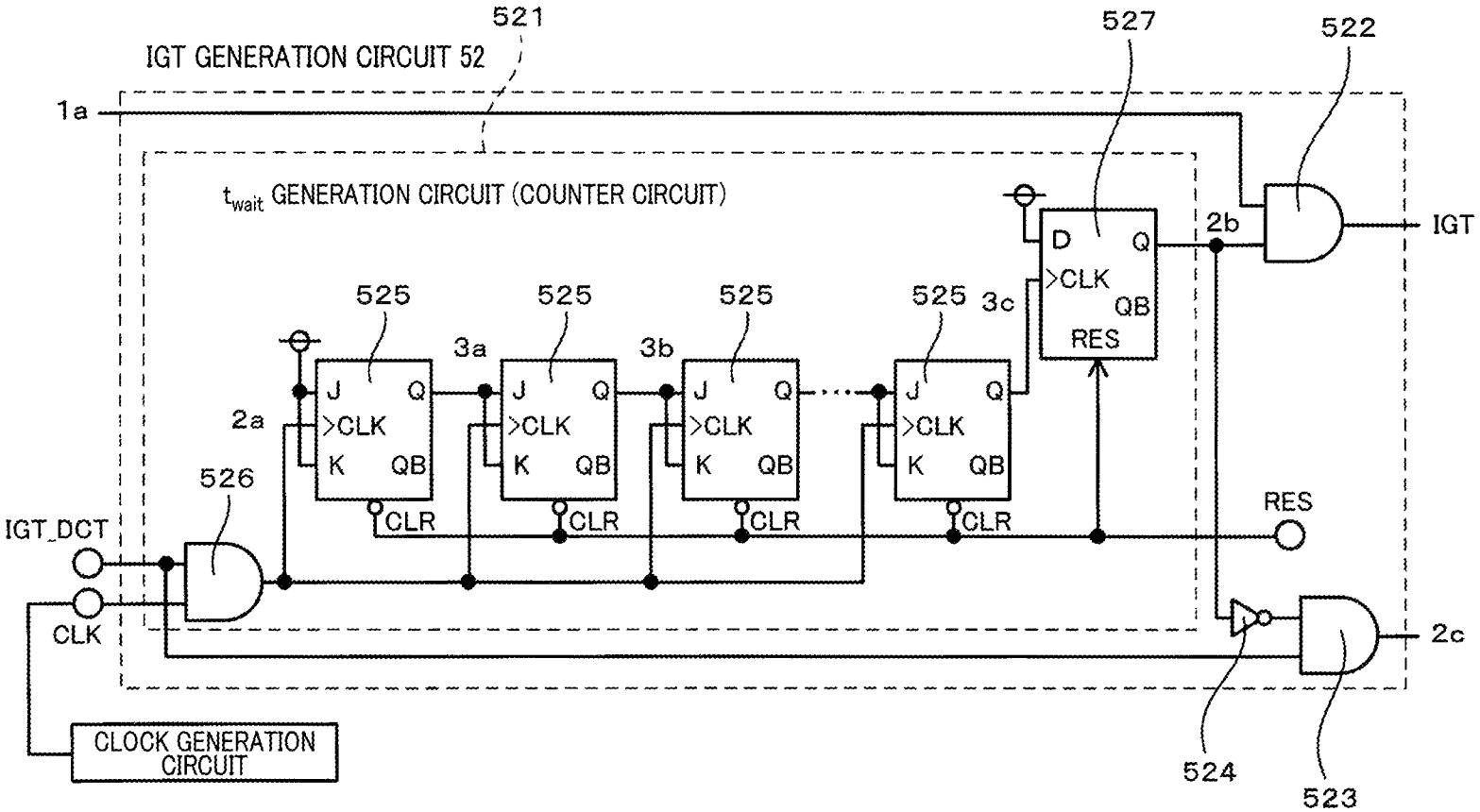
FIG. 8 is a circuit configuration diagram of an IGT generation circuit forming a part of the ignition device according to the first embodiment.

As shown in FIG. 8, the IGT generation circuit 52 includes a waiting time generation circuit (hereinafter referred to as a $t_{wait}$ generation circuit) 521 for generating the waiting time $t_{wait}$, AND circuits 522, 523, and an inverter circuit 524. The square wave signal 1*a* and the signal IGT_DCT from the waveform shaping circuit 51 are input to the IGT generation circuit 52, and the $t_{wait}$ generation circuit 521 generates a signal 2*b* for confirming that the predetermined waiting time $t_{wait}$ has been kept. The AND circuit 522 generates the main ignition signal IGT based on the signal 2*b* output from the $t_{wait}$ generation circuit 521 and the square wave signal 1*a*, and the AND circuit 523 generates a signal 2*c* based on a signal obtained by inverting the signal 2*b* from the $t_{wait}$ generation circuit 521 by the inverter circuit 524 and the signal IGT_DCT.

The $t_{wait}$ generation circuit 521 is formed by using, for example, a counter circuit including multiple stages (N stages) of JK flip-flop circuits 525. The J terminal and K terminal of the JK flip-flop circuit 525 of the first stage are connected to a power supply to receive a potential corresponding to the H level. The signal 2*a* from the AND circuit 526 is input to the CLK terminal of the JK flip-flop circuit 525 of each stage, and the Q terminal of the JK flip-flop circuit 525 of each stage is connected to the J terminal and K terminal of the JK flip-flop circuit 525 of the subsequent stage. The Q terminal of the JK flip-flop circuit 525 of the final stage (Nth stage) is connected to the CLK terminal of the D flip-flop circuit 527.

A reset signal RES from the reset signal generation circuit 55 is input to the clear terminal (hereinafter referred to as the CLR terminal) of the JK flip-flop circuit 525 of each stage so that they are reset when the reset signal RES switches from the H level to the L level. Similarly, a reset signal RES is input to the RES terminal of the D flip-flop circuit 527 so that it is reset when the reset signal falls.

The signal IGT_DCT and a clock signal from an external clock generation circuit are input to the AND circuit 526. When the clock signal rises after the rise of the signal IGT_DCT, the signal 2*a* is output to the JK flipflop circuit 525 of each stage in synchronization with the clock signal.

Figure 9:
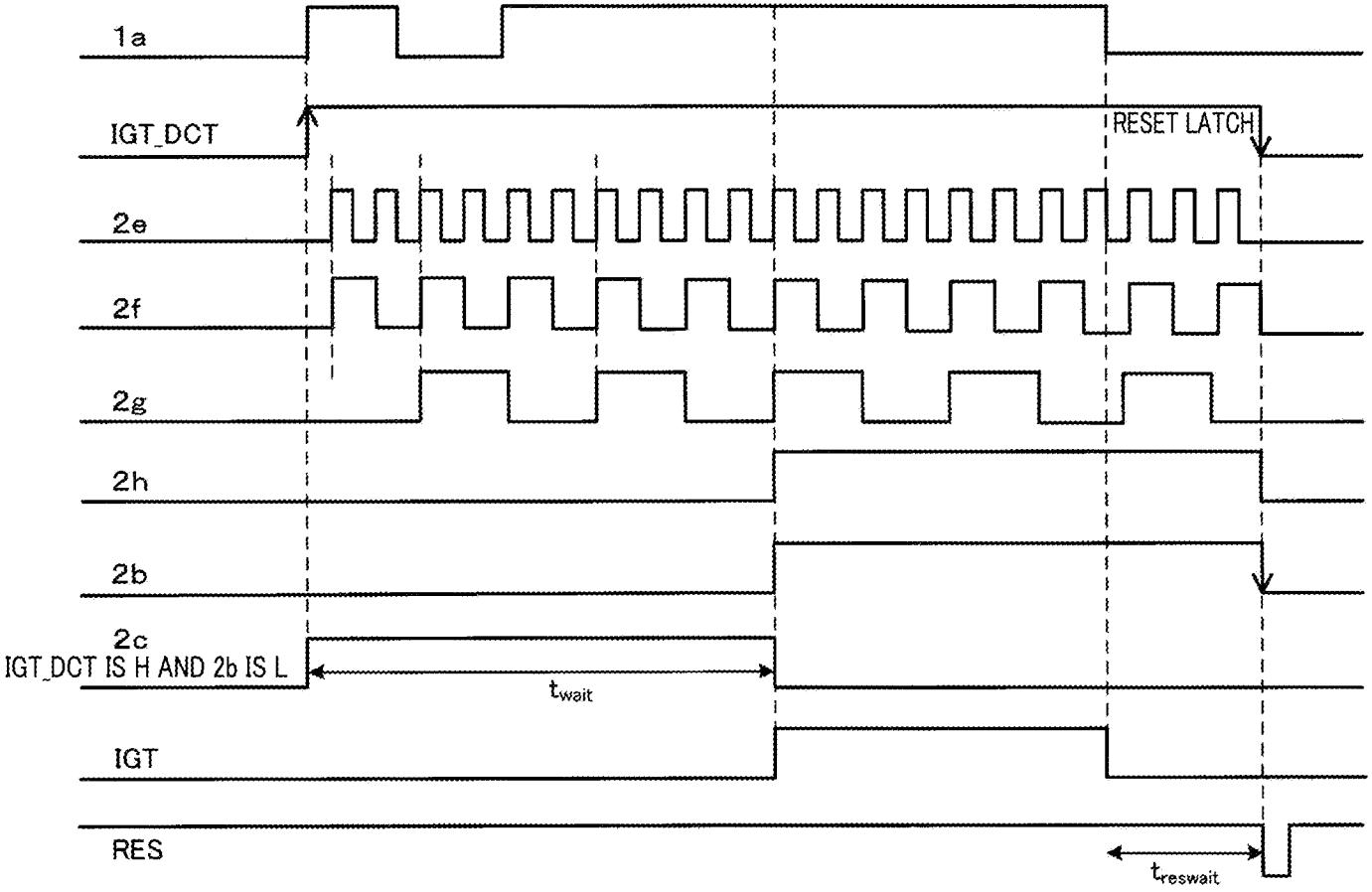
FIG. 9 is a time chart diagram showing the relationship between the ignition control signal and the various signals generated in the IGT generation circuit according to the first embodiment.

Thus, as shown in FIG. 9, when the signal 2*a* from the AND circuit 526 rises to the H level after the signal IGT_DCT has risen to the H level in synchronization with the square wave signal 1*a*, the counter operation is started. In the initial state, the output 3*a* of the first-stage JK flip-flop circuit 525, the output 3*b* of the second-stage JK flip-flop circuit 525, . . . . And the output 3*c* of the final-stage JK flip-flop circuit 525 are all at the L level. Then, each time the signal 2*a* is output, the output 3*a* of the first-stage JK flip-flop circuit 525 is inverted and input to the J terminal and K terminal of the second-stage JK flip-flop circuit 525. Each time the output 3*a* of the first-stage JK flip-flop circuit 525 rises, the output 3*b* of the second-stage JK flip-flop circuit 525 is inverted, and similarly, the signal is transmitted to the JK flip-flop circuits 525 of the subsequent stages.

By repeating this sequentially, the output 3*c* of the final-stage JK flip-flop circuit 525 will be inverted by the input from the previous stage. Then, when an H level signal is input to the CLK terminal of the D flip-flop circuit 527, the signal 2*b* output from the D flip-flop circuit 527 rises to the H level.

The number of stages of the JK flip-flop circuits 525 is appropriately set so that a time corresponding to the predetermined waiting time $t_{wait}$ can be measured.

The main ignition signal IGT output from the AND circuit 522 rises to the H level after the waiting time $t_{wait}$ from the rise of the square wave signal 1*a* in response to the signal 2*b* and the square wave signal 1*a* shifting to the H level. After that, the main ignition signal IGT falls to the L level in synchronization with the fall of the square wave signal 1*a*. The signal 2*c* output from the AND circuit 523 has the H level during the period from the rise of the square wave signal 1*a* to the rise of the signal 2*b* in response to the inverted signal of the signal 2*b* and the signal IGT_DCT having the H level. This period corresponds to the waiting time $t_{wait}$, and when the main ignition signal IGT rises, the signal 2*c* falls to the L level.

Further, after a predetermined reset period $t_{reswait}$ from the fall of the square wave signal 1*a* and main ignition signal IGT, the reset signal RES falls. As a result, the latches of the JK flip-flop circuits 525 and the D flip-flop circuit 527 are reset similarly to the signal IGT_DCT.

The main ignition signal IGT is thus generated in response to the output of the square wave signal 1*a*.

Figure 10:
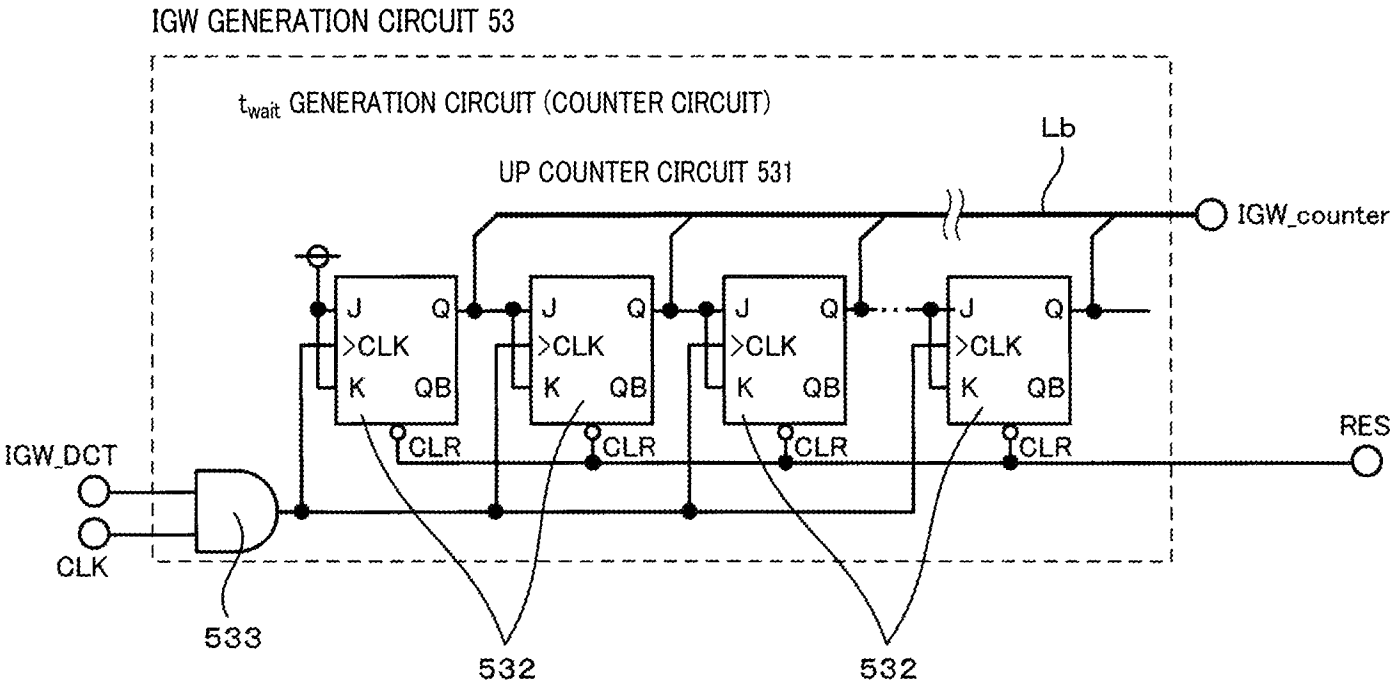
FIG. 10 is a circuit configuration diagram of an IGW generation circuit forming a part of the ignition device according to the first embodiment.
Figure 11:
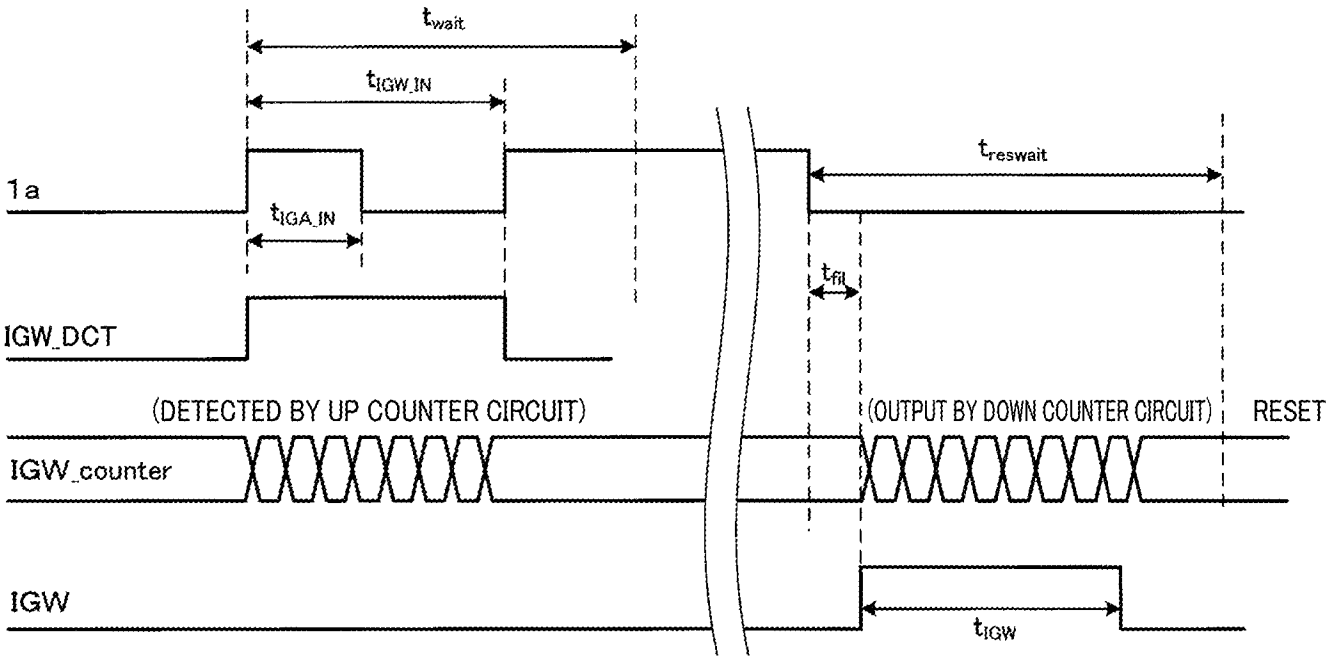
FIG. 11 is a timing chart diagram showing the relationship between the ignition control signal and the various signals generated in the IGW generation circuit according to the first embodiment.

The IGW generation circuit 53 detects, for example, as shown in FIG. 11, the rising interval $t_{IGW_IN}$ of the signal IGW_DCT using an up counter circuit 531 shown in FIG. 10, and uses the detected rising interval $t_{IGW_IN}$ to generate the energy input signal IGW. The rising interval $t_{IGW_IN}$ may be set as it is as the energy input period $t_{IGW}$, or a value obtained by multiplying the rising interval $t_{IGW_IN}$ with a predetermined coefficient (for example, 2 or ½) may be set as the energy input period $t_{IGW}$. The IGW generation circuit 53 includes, for example, a down counter circuit having a structure equivalent to that of the up counter circuit 531.

Specifically, in FIG. 10, the up counter circuit 531 includes a plurality of stages (N stages) of JK flip-flop circuits 532 and an AND circuit 533. The J terminal and K terminal of the JK flip-flop circuit 532 of the first stage are connected to a power supply to receive a potential corresponding to the H level. The Q terminal is connected to the J terminal and K terminal of the second-stage JK flip-flop circuit 532, and in addition, it is also connected to a bus line Lb leading to an N-bit bit counter (IGW_COUNTER). Likewise, the Q terminal of the JK flip-flop circuit 532 of each of the second and later stages is connected to the J terminal and K terminal of the JK flip-flop circuit 532 of the subsequent stage and the bus line Lb.

The signal IGW_DCT and a clock signal from a clock generation circuit (not shown) are input to the AND circuit 533. Therefore, when the clock signal rises after the rise of the signal IGT_DCT, a signal from the AND circuit 533 is input to the CLK terminal of the JK flip-flop circuit 532 of each stage.

A reset signal RES from the reset signal generation circuit 55 is input to the CLR terminal of the JK flip-flop circuit 532 of each stage so that they are reset when the reset signal falls.

Thus, as shown in FIG. 11, when the signal from the AND circuit 533 rises to the H level after the signal IGW_DCT has risen to the H level in synchronization with the square wave signal 1*a*, the counter operation is started by the up counter circuit 531. In the initial state, the output of the first-stage JK flip-flop circuit 532 is at the L level, and the outputs of the JK flip-flop circuits 532 of the second and later stages are all at the L level. Then, when the signal from the AND circuit 533 is input to the CLK terminal of each stage, the output of the first-stage JK flip-flop circuit 532 is inverted and output to the bus line Lb and the J terminal and K terminal of the second-stage JK flip-flop circuit 532.

That is, the output of the first-stage JK flip-flop circuit 532 switches to the H level, whereas the outputs of the subsequent stages remain at the L level. After that, each time a signal from the AND circuit 533 is input, the signal is transmitted to the JK flip-flop circuit 532 of the subsequent stage, and the outputs are sequentially switched to the H level. These outputs are output to the bit counter IGW_COUNTER via the bus line Lb so that the up counter circuit 531 can measure the time while the signal IGW_DCT is at the H level.

The measured length of the signal IGW_DCT is kept as the rising interval $t_{IGW_IN}$ (that is, the interval from the first rise to the second rise of the square wave signal 1*a*). The IGW generation circuit 53 then raises the energy input signal IGW after a predetermined delay period $t_{fil}$ from the second fall of the square wave signal 1*a*, and starts counting down the time corresponding to the kept rising interval $t_{IGW_IN}$. The down counter circuit can have a configuration similar to that of the up counter circuit 531.

In this way, the energy input signal IGW is generated by outputting an H level signal during the energy input period $t_{IGW}$ after the main ignition signal IGT.

Figure 12:
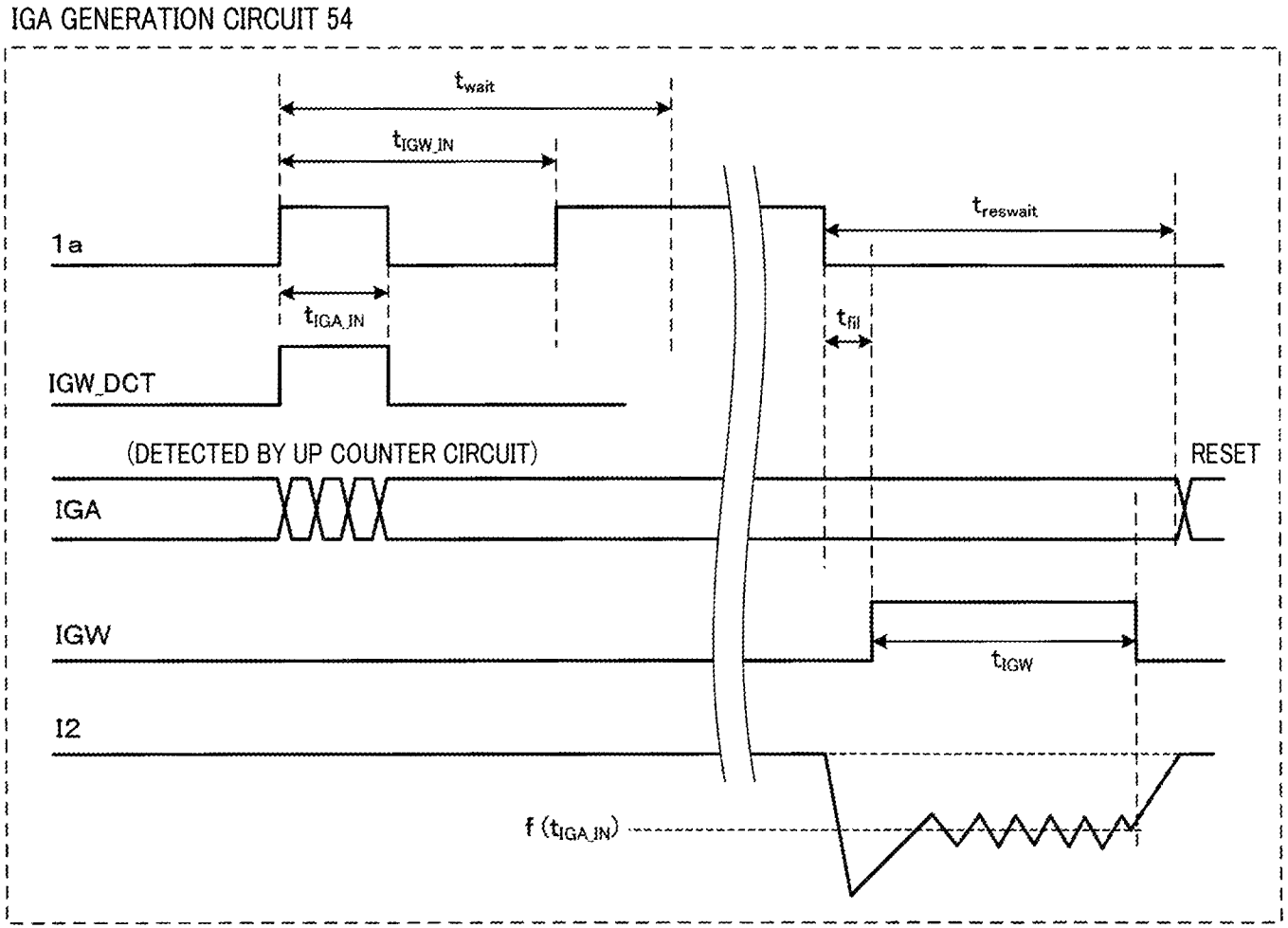
FIG. 12 is a timing chart diagram showing the relationship between the signals generated in the IGA generation circuit forming a part of the ignition device and the energy input operation according to the first embodiment.

As shown in FIG. 12, the IGA generation circuit 54 detects the rising period $t_{IGA_IN}$ of the signal IGA_DCT, and uses the detected rising period $t_{IGA_IN}$ to generate the target secondary current instruction signal IGA. The detection of the rising period $t_{IGA_IN}$ of the signal IGA_DCT may be done using, for example, as with the above-described rising interval $t_{IGW_IN}$, an up counter circuit having a configuration similar to that of the up counter circuit 531 shown in FIG. 10.

The rising period $t_{IGA_IN}$ indicates the target secondary current value I2*tgt* (absolute value) to be used in the energy input operation after the main ignition operation, like the example shown in Table 1 below. That is, the target secondary current value I2*tgt* is expressed by a function $f(t_{IGA_IN})$ of the rising period $t_{IGA_IN}$, and the target secondary current value I2*tgt* is variably set according to the length of the rising period $t_{IGA_IN}$. For example, when $t_{IGA_IN}<0.25$ ms, the target secondary current value I2*tgt* may be set to 60 mA, when 0.25 ms$\leq t_{IGA_IN}<0.75$ ms, the target secondary current value I2*tgt* may be set to 90 mA, and when 0.75 ms$\leq t_{IGA_IN}$, the target secondary current value I2*tgt* may be set to 120 mA. When no rise of $t_{IGA_IN}$ is detected, the energy input operation is not performed and the target secondary current value I2*tgt* is set to 0 mA.

TABLE 1

| $t_{IGA_IN}$ | I2tgt = $f(t_{IGA_IN})$ |
|---|---|
| No fall detected during waiting time | No energy input operation (0 mA) |
| $t_{IGA_IN}$ < 0.25 ms | 60 mA |
| 0.25 ms ≤ $t_{IGA_IN}$ < 0.75 ms | 90 mA |
| 0.75 ms ≤ $t_{IGA_IN}$ | 120 mA |

Accordingly, the up counter circuit performs counting while the signal IGA_DCT is at the H level to detect the rising period $t_{IGA_IN}$ (that is, the length from the first rise to the fall of the square wave signal 1*a*) and keep it. Next, when the energy input signal IGW rises after a predetermined delay period $t_{fil}$ from the main ignition operation due to the second fall of the square wave signal 1*a*, the secondary current feedback control is performed so that the target secondary current value I2*tgt*, which is set based on the rising period $t_{IGA_IN}$, is maintained during the energy input period $t_{IGW}$.

Specifically, based on the detected value of the secondary current I2, the secondary current feedback circuit 61 (see, for example, FIG. 1) outputs a gate signal MOS_gate1 and a gate signal MOS_gate2 from the auxiliary primary coil control circuit 4 to control the on/off of the discharge continuation switch SW2 and the flyback switch SW3, so that the secondary current I2 is maintained around the target secondary current value I2*tgt*.

Figure 13:
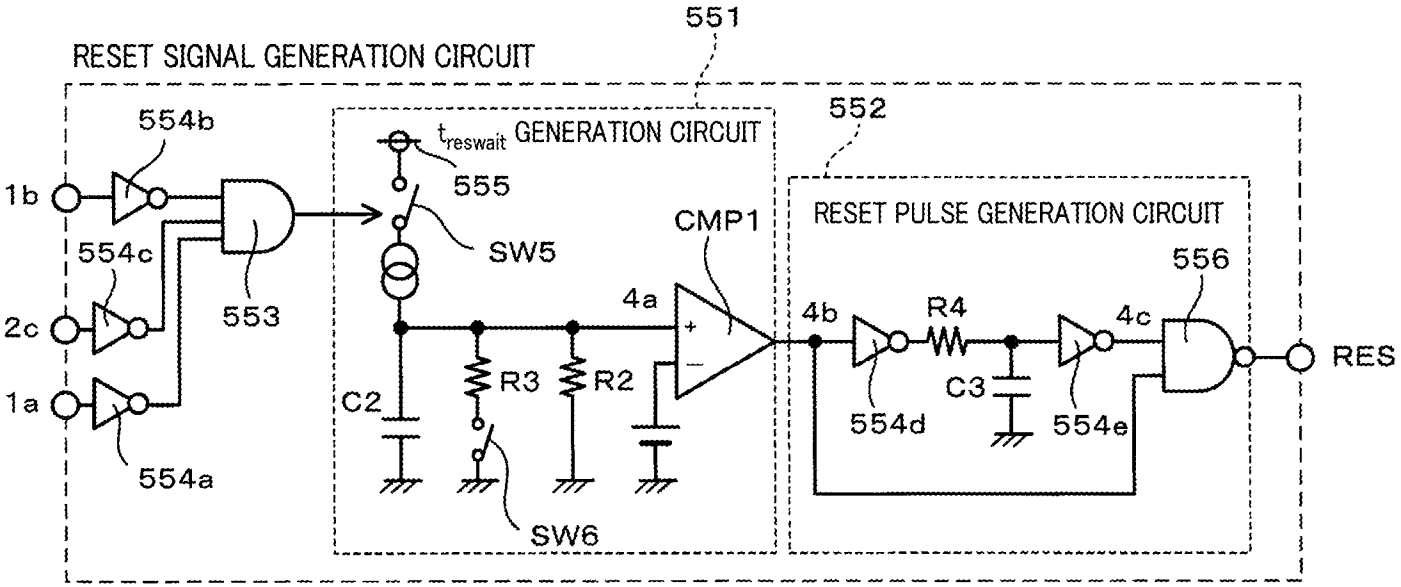
FIG. 13 is a circuit configuration diagram of a reset circuit forming a part of the waveform shaping circuit according to the first embodiment.

As shown in FIG. 13, the reset signal RES generation circuit 55 is configured by using, for example, a $t_{reswait}$ generation circuit 551 that generates the reset period $t_{reswait}$ and a reset pulse generation circuit 552 that generates the pulse reset signal RES. The AND circuit 553 connected to the input side of the $t_{reswait}$ generation circuit 551 receives a signal obtained inverting the square wave signal 1*a* from the waveform shaping circuit 51 via the inverter circuit 554*a*, and a signal 1*d* obtained by inverting the signal 1*b* for detecting the second rise via the inverter circuit 554*b*, and a signal obtained by inverting the signal 2*c* inverted from the IGT generation circuit 52 via the inverter circuit 554*c*.

The $t_{reswait}$ generation circuit 551 may be configured by using a counter circuit (digital circuit) like the IGW generation circuit 53 and the IGA generation circuit 54 described above, but as shown in the figure, it may be configured as an analog circuit including a constant current source 555, a capacitor C2, and a comparator CMP1. In the $t_{reswait}$ generation circuit 551, the switch SW5 is turned on when the signal from the AND circuit 553 is at the H level, and the capacitor C2 is connected to the constant current source 555 so that a constant current flows. As a result, the capacitor C2 is charged, and the input potential 4*a* of the positive terminal of the comparator CMP1 connected to the capacitor C2 exceeds the reference potential supplied to the negative terminal. The signal 4*b* from the comparator CMP1 then shifts to the H level.

One end of a resistor R2 is grounded and its other end is connected between the capacitor C2 and the comparator CMP1. and the time constant of the capacitor C2 and the resistor R2 can be used to adjust the predetermined reset period $t_{reswait}$. Note that a resistor R3 for discharging may be further provided in parallel with the resistor R2, and the line between it and the ground potential may be opened/closed using a switch SW6 for discharging. For example, rapid discharge can be realized by turning on the switch SW6 for discharging in synchronization with the latch resetting to connect the positive terminal side of the capacitor C2 to the ground potential via the resistor R3 for discharging.

Further, the reset pulse generation circuit 552 has a NAND circuit 556 that outputs reset signals RES. The NAND circuit 556 receives the signal 4*b* from the $t_{reswait}$ generation circuit 551 and also the signal 4*c* from a delay circuit made up of inverter circuits 554*d*, 554*e* and a resistor R4 and a capacitor C3 placed between the inverter circuits.

Figure 14:
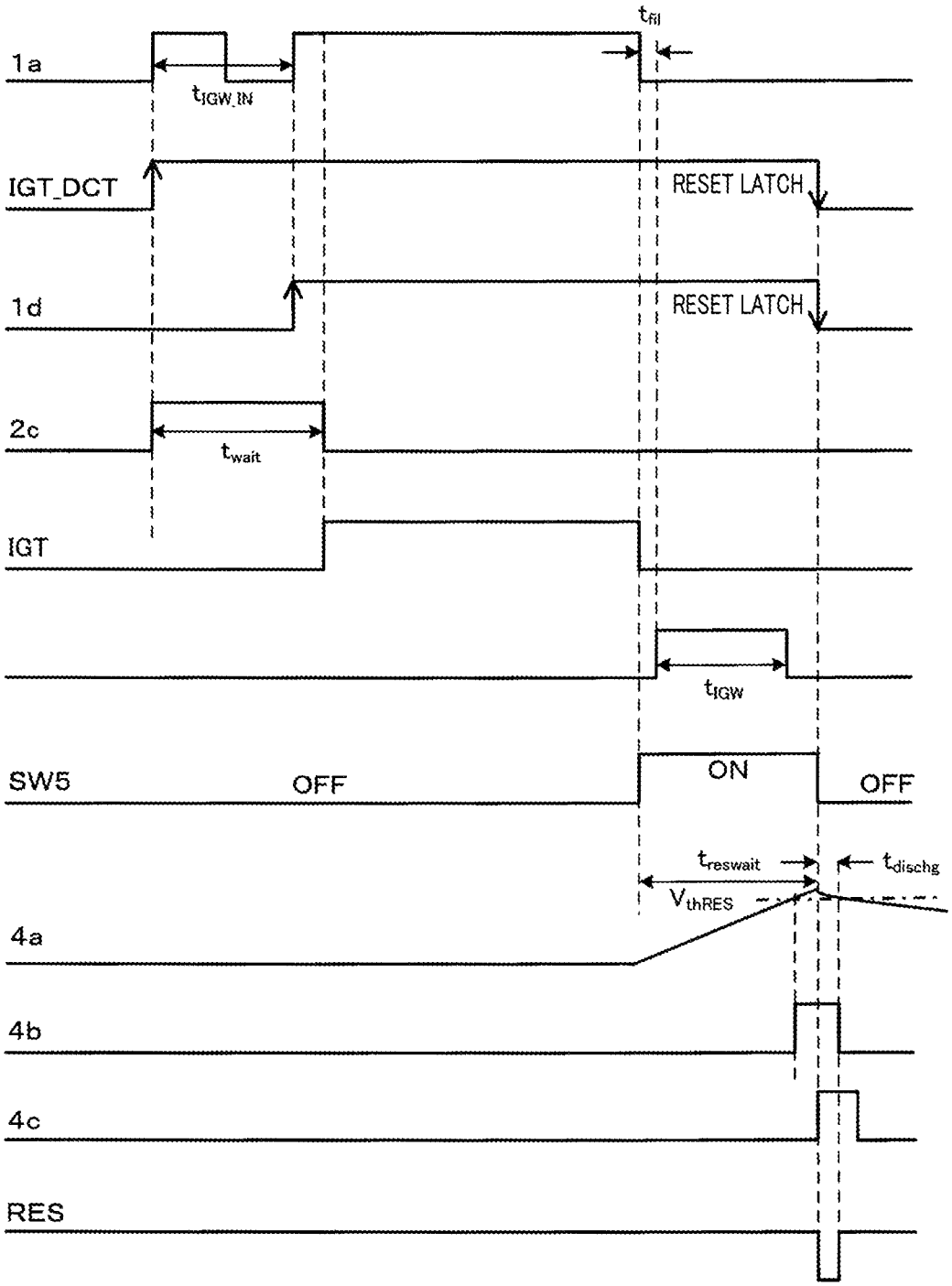
FIG. 14 is a timing chart diagram showing the relationship between the reset signal and various signals generated in the reset circuit according to the first embodiment.

As shown in FIG. 14, the output from the AND circuit 553 is initially at the L level, and it switches to the H level only when the square wave signal 1*a* is at the L level, the signal 1*b* is at the L level (signal 1*d* is at the H level), and the signal 2*c* is at the L level. That is, in the initial state, the switch SW5 is off. After the elapse of the waiting time $t_{wait}$ from the drop of the signal 1*b* to the L level in response to the second rise of the square wave signal 1*a*, the signal 2*c* falls, and further the square wave signal 1*a* falls. Then, it is determined that the ignition control signal IG has ended, and the switch SW5 is turned on.

This causes the potential of the capacitor C2 to gradually rise, and when the input potential 4*a* to the comparator CMP1 reaches a predetermined reference potential $Vth_{RES}$, the signal 4*b* output from the comparator CMP1 shifts to the H level. Then, when the switch SW5 is turned off after the predetermined reset period $t_{reswait}$ and the capacitor C2 is discharged and its potential becomes lower than the reference potential $Vth_{RES}$, the signal 4*b* from the comparator CMP1 shifts to the L level.

The signal 4*b* it at the H level while the switch SW5 is on and the input potential 4*a* is higher than the reference potential $Vth_{RES}$. The signal 4*c* is a signal obtained by delaying the signal 4*b*. Since the switch SW5 is initially off, the output of the comparator CMP1 is at the L level and the signal 4*c* is at the L level. The signal 4*c* and the signal 4*b* are input to the NAND circuit 558, and the reset signal RES output from it has the L level only when both of these signals are at the H level.

That is, the reset signal RES is at the H level in the initial state, and when the switch SW5 is turned on in response to the second fall of the square wave signal 1*a*, the signal 4*b* shifts to the H level with a certain delay. When the signal 4*c* obtained by delaying the signal 4*b* shifts to the H level, the reset signal RES falls to the L level. As a result, the latch of each circuit is reset, the signal 1*d* shifts to the L level, the switch SW5 is turned off, and the capacitor C2 is discharged, which causes the signal 4*b*, which is the output of the comparator CMP1, to shift to the L level after a predetermined time period tdischg. This in turn causes the reset signal RES to rise to the H level again and return to the initial state.

The reset pulse signal RES can be output from the reset pulse generation circuit 552 in such a manner. Note that the reset period $t_{reswait}$ is set to be longer than the energy input period $t_{IGW}$ in order to prevent the reset operation being carried out during the energy input operation. Preferably, in consideration of the delay period $t_{fil}$ after the main ignition operation, the period during which the switch SW5 is on corresponding to the reset period $t_{reswait}$ is set as appropriate so that the reset operation is performed after the energy input period $t_{IGW}$ has elapsed.

As described above, according to the present embodiment, the engine ECU 100 transmits the ignition control signal IG including information for the main ignition signal IGT, the energy input signal IGW, and the target secondary current instruction signal IGA to the ignition device 10 in advance. The transmitted ignition control signal can be separated into the individual signals in the signal separation circuit unit 5. The separated signals are output at certain timings to perform the main ignition operation and the energy input operation. That is, the engine ECU 100 outputs the ignition control signal IG at a timing that is earlier than the output of the main ignition signal IGT by the waiting time $t_{wait}$. Since the signals required for main ignition and energy input can be generated in advance, it is possible to reduce the number of signal lines connecting the devices and implement the ignition control device 1 capable of suppressing the influence of noise and other influences with a simple configuration.

Note that the ignition control signal IG does not necessarily have to consist of the first signal IG1 and the second signal IG2. For example, it may be a signal that rises at a timing that is earlier than the rise of the main ignition signal IGT by the waiting time $t_{wait}$, and falls at the same timing as the main ignition signal IGT. In that case, a single ignition control signal IG that is longer than the main ignition signal IGT by the waiting time $t_{wait}$ is output from the engine ECU 100 at a timing earlier than the output of the main ignition signal IGT by the waiting time $t_{wait}$. This enables application to a normal ignition operation that does not involve energy input.

Examples of modifications of the above-described ignition control signal IG will be described with reference to the following second to fourth embodiments.

Second Embodiment

The second embodiment according to the ignition control device will be described with reference to FIG. 15.

In the first embodiment, a case has been described where the ignition control signal IG is separated into individual signals in the signal separation unit 5 of the ignition control device 1 shown in FIG. 1 to carry out the main ignition operation and the energy input operation. In this embodiment, the signal waveform of the ignition control signal IG is different, and only the main ignition operation is performed based on the main ignition signal IGT generated by being separated from the ignition control signal IG. The differences will be mainly described.

Note that, among the reference signs used in the second and following embodiments, reference signs that are the same as those used in an earlier embodiment denote components or the like that are similar to those of the earlier embodiment unless otherwise noted.

The basic configuration and operation of the ignition control device 1 of this embodiment are the same as those of the first embodiment, and their description will be omitted.

Figure 15:
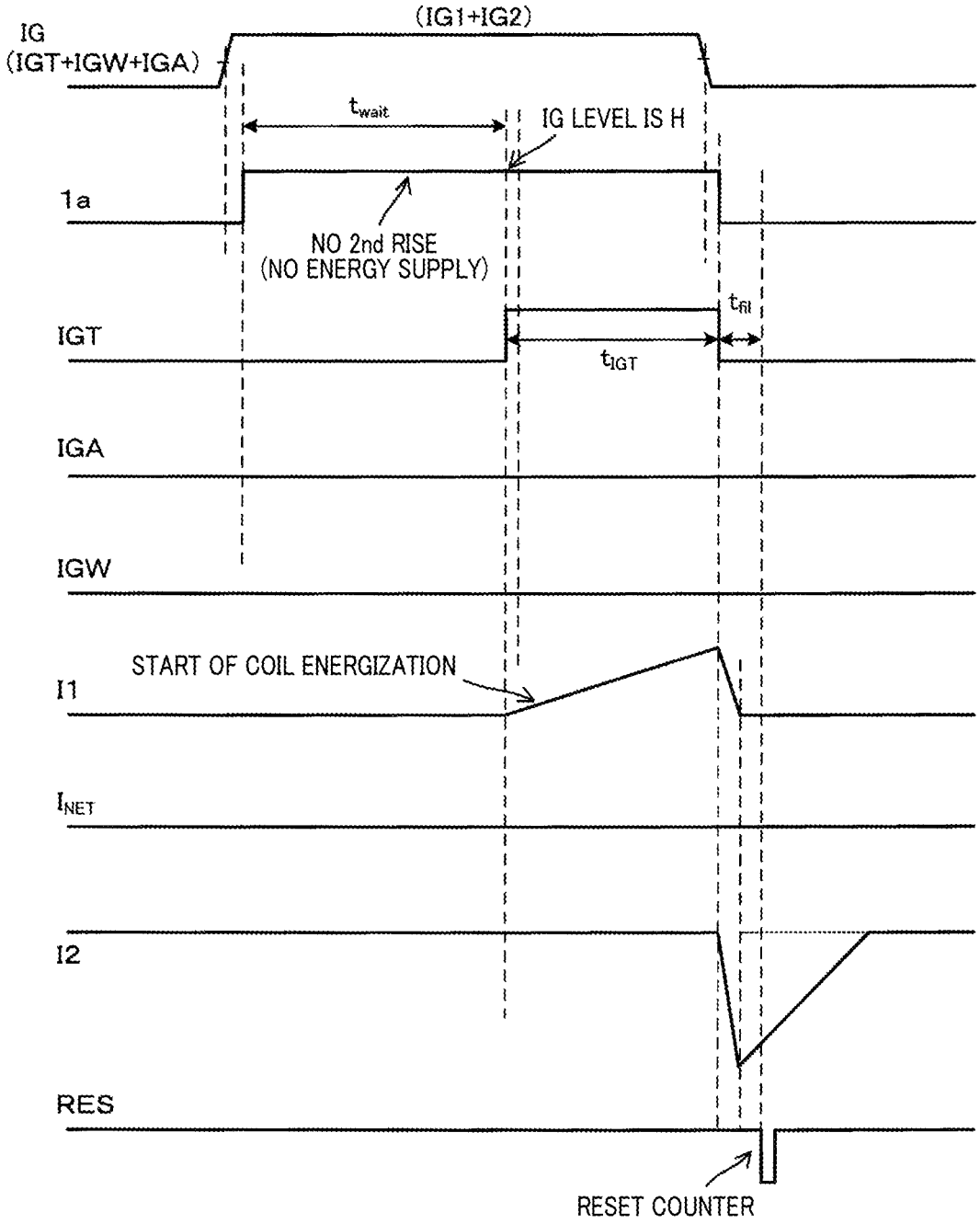
FIG. 15 is a timing chart diagram showing the relationship between the ignition control signal and the various signals generated in the signal separation circuit unit, and the processes of the main ignition operation and the energy input operation according to the second embodiment.

As shown in FIG. 15, the ignition control signal IG formed of one pulse signal, and it is received as a signal that substantially combines the first pulse signal IG1 and the second pulse signal IG2 together. In this case, the square wave signal 1*a* obtained by shaping the waveform of the ignition control signal IG is also a single pulse signal, and the main ignition signal IGT is generated based on its rising and falling edges.

Specifically, the waveform shaping circuit 51 of the signal separation circuit unit 5 shapes the waveform of the ignition control signal IG and outputs the obtained square wave signal 1*a*, and when the waiting time $t_{wait}$ has passed from the rise of the square wave signal 1*a* and the signal level is the H level in the IGT generation circuit 52, the main ignition signal IGT rises at that time point. When the signal level of the square wave signal 1*a* shifts to the L level after the rising, the main ignition signal IGT falls at that time point. The main ignition signal IGT is thus generated.

In accordance with this, the main ignition drive circuit 31 drives the main ignition switch SW1. Energization of the main primary coil 21*a* starts at the time at which the main ignition signal IGT rises so that the primary current I1 flows. Then, by cutting off the energization of the main primary coil 21*a*, a high voltage is generated in the secondary coil 22 and the secondary current I2 flows.

Similarly, the IGW generation circuit 53 and the IGA generation circuit 54 generate the energy input signal IGW and the target secondary current instruction signal IGA based on the square wave signal 1*a*. However, since no falling or second rising of the square wave signal 1*a* is detected during the waiting time $t_{wait}$ from the rise of the square wave signal 1*a*, the energy input signal IGW and the target secondary current instruction signal IGA remain at the L level, and therefore the energy input operation will not be performed.

By forming the ignition control signal IG such that it has a signal waveform including one or two pulses as described above, it is possible to start the main ignition operation and also indicate whether to perform the energy input operation. When the energy input operation is not to be performed, the signal from the engine ECU 100 is set such that the rising period $t_{IGT}$ of the main ignition signal IGT required for the engine operating conditions is started during the waiting time $t_{wait}$ That is, the waiting time $t_{wait}$ overlaps with the rising period $t_{IGT}$, and the ignition control signal IG is transmitted as one signal in which the first signal IG1 and the second signal IG2 cannot be distinguished. In other words, the device can be easily applied to cases where only the main ignition operation is performed and the energy input is not by transmitting the signal from the engine ECU 100 at a timing that is earlier than the rising period $t_{IGT}$ by the waiting time $t_{wait}$.

Further, it can be determined that no rising signal of the ignition control signal IG is detected during the waiting time $t_{wait}$ when the IGW_counter of the IGW generation circuit has a count corresponding to the waiting time $t_{wait}$. In that case, since the energy input operation becomes unnecessary, the counters for the main ignition signal IGT, the energy input signal IGW, the target secondary current instruction signal IGA, and the like can be quickly reset after a predetermined delay period $t_{fil}$ from the main ignition operation. This makes it possible to proceed to the next ignition operation without waiting for the reset period $t_{reswait}$ to pass.

Third Embodiment

The third embodiment according to the ignition control device will be described with reference to FIG. 16.

In the second embodiment, a case has been described where only the main ignition operation is performed based on the signal waveform of the ignition control signal IG in the ignition control device 1 shown in FIG. 1. In the present embodiment, an example case is described where whether to perform the main ignition operation is determined based on the waiting time $t_{wait}$ in the signal waveform, and the main ignition operation is not performed.

The basic configuration and operation of the ignition control device 1 of this embodiment are the same as those of the first and second embodiments, and the differences will be mainly discussed.

Figure 16:
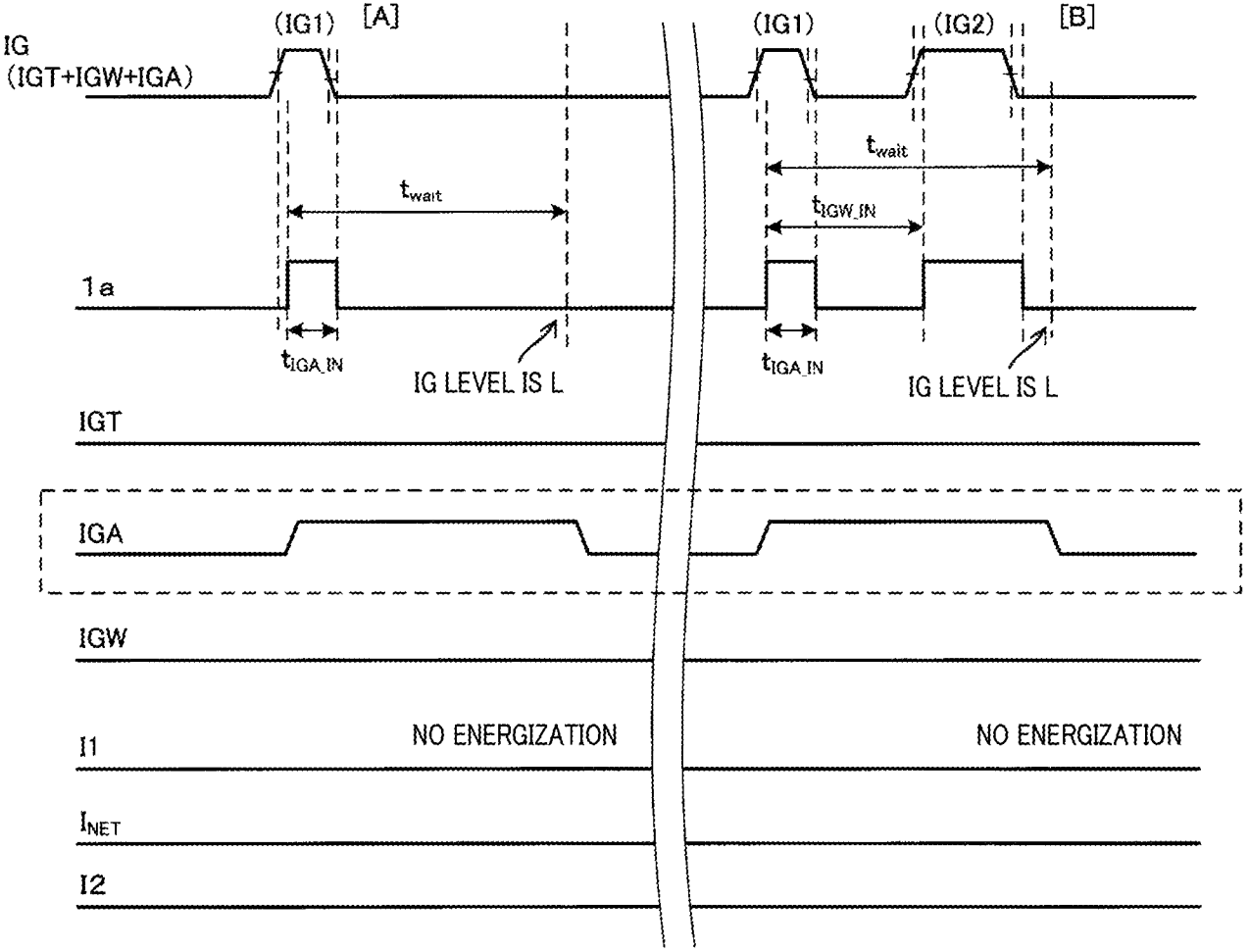
FIG. 16 is a timing chart diagram showing the relationship between the ignition control signal, the various signals generated in the signal separation circuit unit, and the waiting time according to the third embodiment.

The ignition control signal IG shown in the left part [A] of FIG. 16 is formed of one pulse signal, and, for example, has a relatively short pulse width corresponding to the first signal IG1. In this case, when the waiting time $t_{wait}$ has passed from the rise of the square wave signal 1*a* obtained by waveform-shaping, the signal level shifts to the L level and the main ignition signal IGT is not output.

Specifically, when the waveform shaping circuit 51 of the signal separation circuit unit 5 shapes the waveform of the ignition control signal IG and outputs the obtained square wave signal 1*a*, the target secondary current instruction signal IGA is generated in the IGA generation circuit 54 based on its rising period $t_{IGA_IN}$. However, since a signal corresponding to the second signal IG2 is not received after that, and no second rise of the square wave signal 1*a* is detected during the waiting time $t_{wait}$ from the rise of the square wave signal 1*a*, the main ignition signal IGT and the energy input signal IGW will not be output.

Energization of the main primary coil 21*a* will not be started, and the primary current I1 will not flow. That is, the main ignition operation and the energy input operation will not be performed, and the secondary current I2 and the current $I_{NET}$ will not flow either.

Therefore, if the main ignition operation becomes unnecessary for some reason such as a change in the engine operating conditions after receiving the first signal IG1, the main ignition operation can be stopped by stopping the transmission of the second signal IG2 from the engine ECU 100.

Further, for example, when noise caused by the ignition operation of another cylinder or another unintended signal is input, even if the signal separation circuit unit 5 regards it as the first signal IG1, the main ignition signal IGT is not generated if the second signal IG2 is not input. This prevents erroneous operation.

As shown in the right part [B] of FIG. 16, even when the ignition control signal IG is composed of two pulse signals, if the signal level of the second signal IG2 shifts to the L level before the elapse of the waiting time $t_{wait}$ from the rise of the square wave signal 1*a*, the main ignition signal IGT will not be generated. In this case, since a second rise of the square wave signal 1*a* is detected during the waiting time $t_{wait}$ after the rise of the square wave signal 1*a*, the rising interval $_{IGW_IN}$ will be set but the main ignition signal IGT will not be output, and therefore the energy input signal IGW will not be output.

Accordingly, even after the transmission of the second signal IG2 from the engine ECU 100 has started, it is possible to stop the main ignition operation by stopping the transmission of the second signal IG2 before the waiting time $t_{wait}$ elapses.

With such a configuration, for example, even when external pulse noise similar to the first signal IG1 is input to the ignition device 10, if no subsequent second signal IG2 is input, the main ignition signal IGT will not be generated. Therefore, the ignition control device 1 can have high resistance to noise so that it would not start the main ignition operation based on erroneous signals.

Fourth Embodiment

The fourth embodiment according to the ignition control device will be described with reference to FIGS. 17 and 18.

The third embodiment presents the relationship between the waiting time $t_{wait}$ in the waveform of the ignition control signal IG and the main ignition operation in the ignition control device 1 shown in FIG. 1. In the present embodiment, an example case is described where the waiting time $t_{wait}$ in the signal waveform is variable depending on the engine operating conditions.

The basic configuration and operation of the ignition control device 1 of this embodiment are the same as those of the first to third embodiments, and the differences will be mainly discussed.

Figure 17:
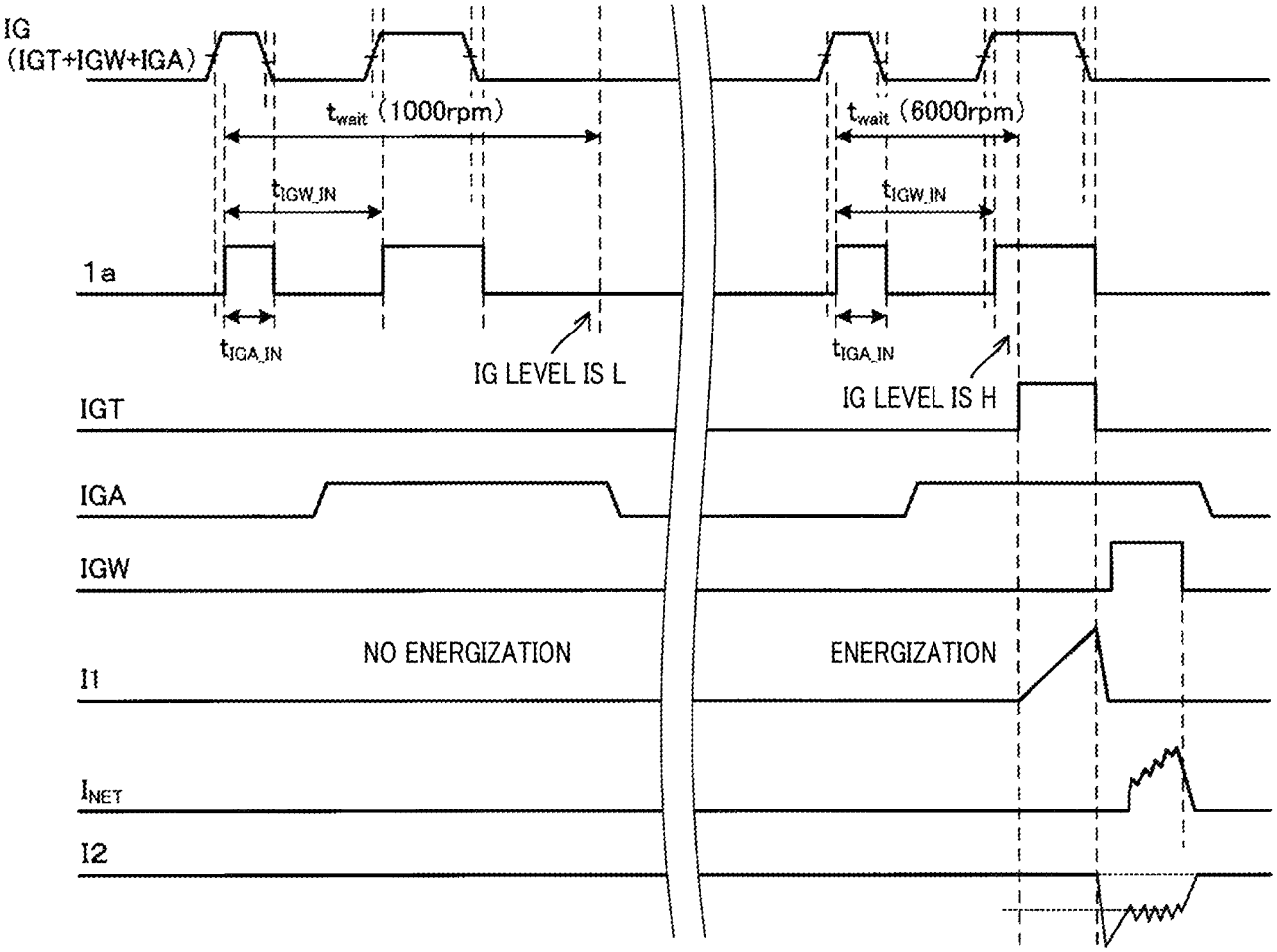
FIG. 17 is a timing chart diagram comparing the relationship between the ignition control signal and the various signals generated in the signal separation circuit unit under a certain waiting time, and their relationship under another waiting time set based on the engine operating condition according to the fourth embodiment.

In FIG. 17, the ignition control signal IG shown on the left and the ignition control signal IG shown on the right have the same waveform composed of the first signal IG1 and the second signal IG2, but they have different waiting time $t_{wait}$, which is variably set according to one or more engine operating conditions. The engine operating condition is, for example, the engine speed, and the higher the engine speed, the shorter the set waiting time $t_{wait}$.

Specifically, as shown in the left part of FIG. 17, in a case where the engine speed is in the low rotation speed range, for example, 1000 rpm (in other words, the period is 120 ms), the waiting time $t_{wait}$ is set longer so that the second signal IG2 falls before the elapse of the waiting time $t_{wait}$. In this case, since the signal level of the square wave signal 1*a* is the L level when the waiting time $t_{wait}$ has passed, only the target secondary current instruction signal IGA is output as in the third embodiment. That is, the main ignition signal IGT is not output and the main ignition operation is not performed.

For example, the waiting time can be set so that, like a hybrid vehicle, the vehicle is motor driven in a predetermined low rotation region by stopping the ignition operation. In that case, the waiting time $t_{wait}$ is set to be long in the corresponding low rotation region so that the second signal IG2 falls before the elapse of the waiting time $t_{wait}$. This provides a setting with which the main ignition signal IGT is not output and the main ignition operation is not performed.

On the other hand, as shown in the right part of FIG. 17, in a case where the engine speed is in the high rotation speed range, for example, 6000 rpm (in other words, the period is 20 ms), the waiting time $t_{wait}$ is set shorter so that the second signal IG2 falls after the elapse of the waiting time $t_{wait}$. The signal level of the square wave signal 1*a* is the H level when the waiting time $t_{wait}$ has passed, and the signal separation circuit unit 5 outputs the main ignition signal IGT, the energy input signal IGW, and the target secondary current instruction signal IGA as in the first embodiment.

Energization of the main primary coil 21*a* starts in synchronization with the rise of the main ignition signal IGT and the primary current I1 flows. The secondary current I2 flows when the energization is cut off. Further, during the period specified by the energy input signal IGW, the energy input operation set by the target secondary current instruction signal IGA is performed. The secondary current I2 is maintained and the current $I_{NET}$ flows.

Since the ignition cycle period changes when the engine speed changes, it is desirable that the waiting time $t_{wait}$ is set so that the main ignition signal IGT is output at an energization timing in accordance with the ignition timing. As described earlier, the main ignition signal IGT rises when the waiting time $t_{wait}$ has passed from the rise of the square wave signal 1*a* and the signal level is the H level. Therefore, it is desirable to set the waiting time $t_{wait}$ shorter in the high rotation range in which the ignition cycle becomes shorter.

Figure 18:
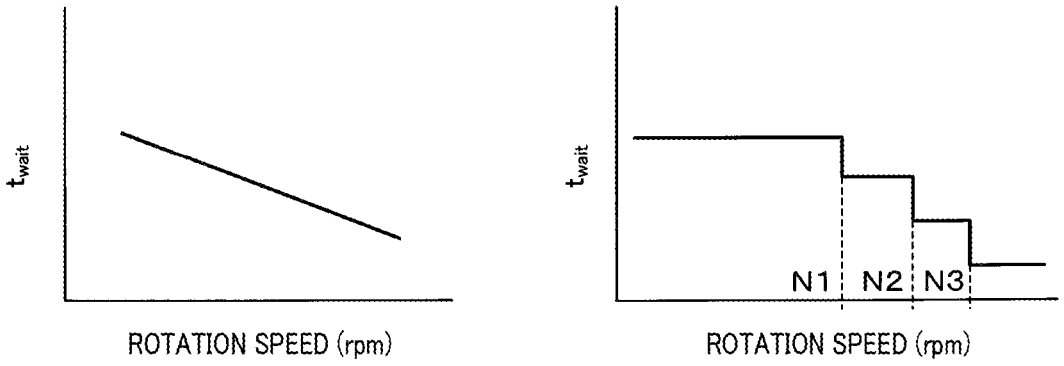
FIG. 18 is a diagram showing the relationship between the engine operating condition and the waiting time set in the signal separation circuit unit according to the fourth embodiment.

As shown in FIG. 18, when the waiting time $t_{wait}$ is changed according to the engine operating conditions, for example, the engine speed, it may be changed continuously or stepwise. Specifically, the waiting time $t_{wait}$ may be set such that the waiting time $t_{wait}$ decreases continuously as the rotation speed increases as shown in the left graph, or the waiting time $t_{wait}$ is constant until the rotation speed reaches a certain rotation speed N1, and decreases stepwise after that each time the rotation speed reaches higher rotation speeds N2, N3 as shown in the right graph.

Fifth Embodiment

The fifth embodiment according to the ignition control device will be described with reference to FIGS. 19 to 21.

This embodiment presents an example of the process of the main ignition operation and the process of the energy input operation performed using the ignition device 10 of the ignition control device 1 according to the first embodiment.

As shown in FIG. 1, the ignition device 10 receives the ignition control signal IG transmitted from the engine ECU 100 at the signal separation circuit 5, and transmits the main ignition signal IGT separated therefrom to the main ignition drive circuit 31 of the main ignition circuit unit 3 and also to the auxiliary primary coil control circuit 41 of the energy input circuit unit 4.

Figure 19:
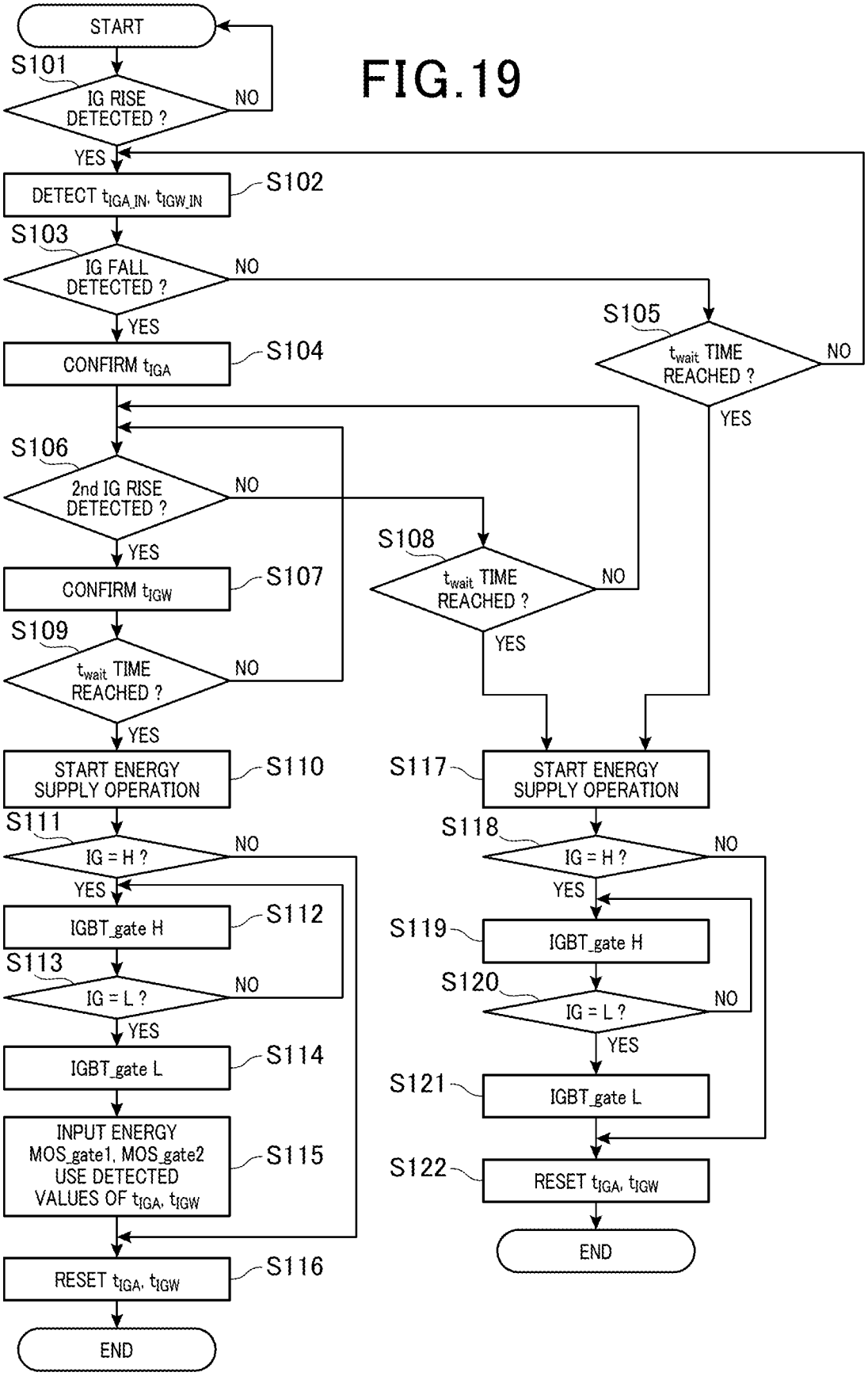
FIG. 19 is a flowchart showing the processes of the main ignition operation and the energy input operation carried out by the ignition control device according to the fifth embodiment.

The flowchart shown in FIG. 19 shows the procedures executed in order to generate individual signals by separating them from the ignition control signal IG in the ignition device 10. FIG. 20 shows the same flowchart with arrows for comparing the processes of the first to third embodiments. Each of the first to third embodiments separates the individual signals from a different ignition control signal IG through a different process. The time chart shown in FIG. 21 corresponds to the first embodiment. The ignition control signal IG includes the first signal IG1 and the second signal IG2 as shown in FIG. 2 referred to earlier, and both the main ignition operation and the energy input operation are carried out.

The procedures of the first embodiment will mainly be described with reference to FIG. 21.

In FIGS. 19 and 20, when the signal separation process is started in the signal separation circuit 5, first, it is determined in step 101 whether a rise of the ignition control signal IG is detected. Here, it is determined whether the first rise of the square wave signal 1*a* (that is, the rise of the first signal IG1) obtained by shaping the waveform of the ignition control signal IG by the waveform shaping circuit 51 is detected.

When the answer is Yes in step 101, the process proceeds to step 102, and when the answer is No, step 101 is repeated until the answer becomes Yes.

In step 102, the IGA generation circuit 54 starts the detection of the rising period $t_{IGA_IN}$ of the square wave signal 1*a*, and the IGW generation circuit 53 starts the detection of the rising interval $t_{IGA_IN}$ of the square wave signal 1*a*. The rising period $t_{IGA_IN}$ is the period from the first rise to the fall of the square wave signal 1*a*, and, in the first embodiment, it corresponds to the rising period of the first signal IG1. The rising interval $t_{IGW_IN}$ is the period from the first rise to the second fall of the square wave signal 1*a*, and, in the first embodiment, it corresponds to the interval between the rise of the first signal IG1 and the rise of the second signal IG2.

Next, in step 103, the IGA generation circuit 54 determines whether the first fall of the square wave signal 1*a* (that is, the fall of the first signal IG1) is detected. When the answer is Yes in step 103, the process proceeds to step 104, and when the answer is No, the process proceeds to step 105.

When the answer is Yes in step 103, in step 104, the rising period $t_{IGA_IN}$ is confirmed and also the target secondary current value I2*tgt*, which is represented by a function of the rising period f ($t_{IGA_IN}$), is confirmed.

Figure 21:
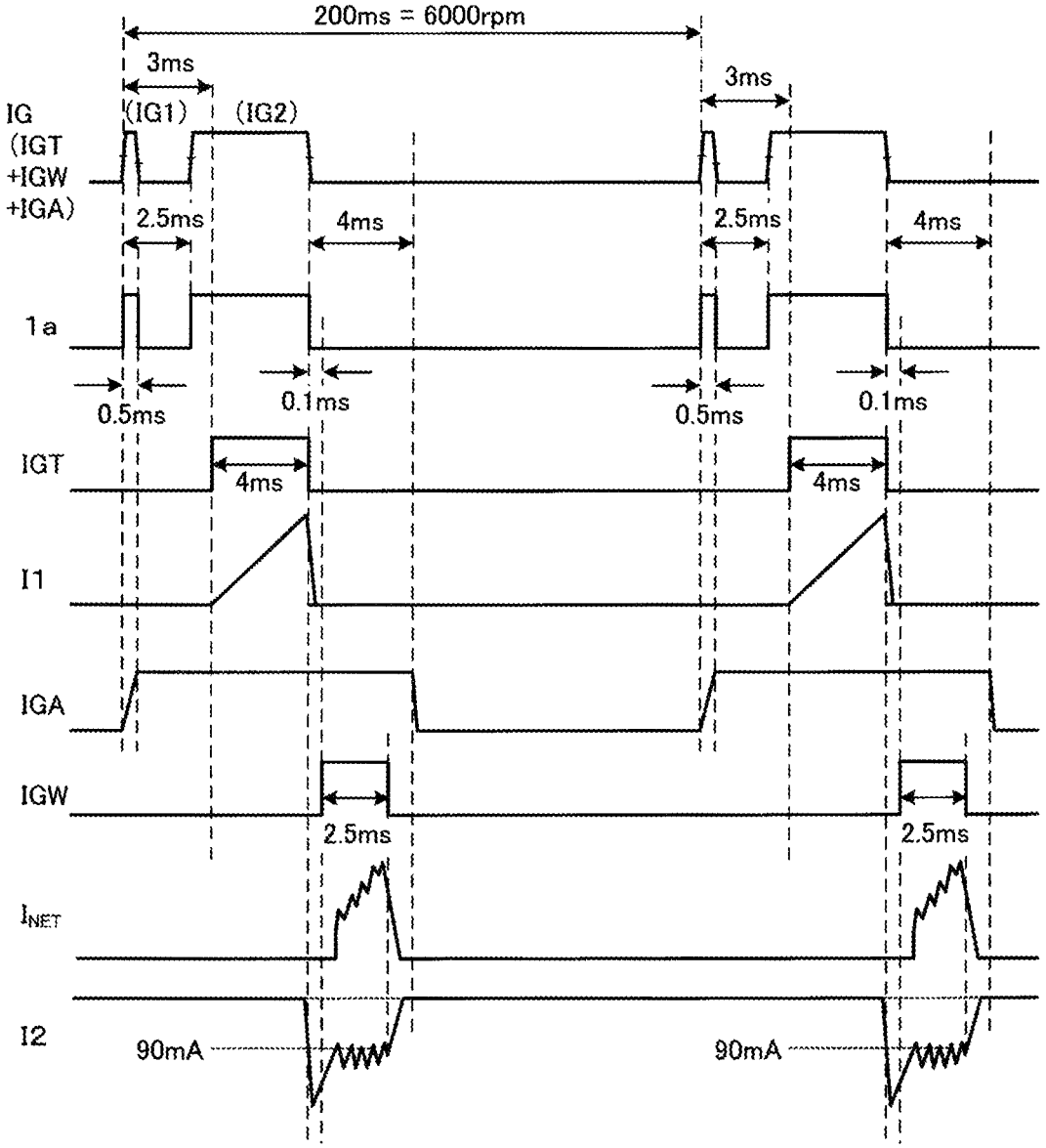
FIG. 21 is a timing chart diagram showing examples of the main ignition operation and the energy input operation carried out by the ignition control device according to the fifth embodiment in the case of the first embodiment.

As shown in FIG. 21, in the first embodiment, the rising period $t_{IGA_IN}$ of the square wave signal 1*a* is detected by detecting the rise and fall of the first signal IG1 (for example, 0.5 ms). Along with this, the target secondary current instruction signal IGA output from the IGA generation circuit 54 gradually rises and then is maintained at a constant value. The target secondary current value I2*tgt* is variably set according to the length of the rising period $t_{IGA_IN}$, and as shown in Table 1 above, for example, when the rising period is 0.5 ms, the target secondary current value I2*tgt* is 90 mA.

Next, in step 106, the IGW generation circuit 53 determines whether the second rise of the square wave signal 1*a* (that is, the rise of the second signal IG2) is detected. When the answer is Yes in step 106, the process proceeds to step 107, and when the answer is No, the process proceeds to step 108.

When the answer is Yes in step 106, in step 107, the rising interval $t_{IGW_IN}$ is confirmed and also the energy input period $t_{IGW}$ is confirmed based on the rising interval.

As shown in FIG. 21, in the first embodiment, the rising interval $t_{IGW_IN}$ of the square wave signal 1*a* is detected by detecting the rise of the first signal IG1 and the rise of the second signal IG2 (for example, 2.5 ms). Along with this, the energy input period $t_{IGW}$ having a length equivalent to that of the rising interval $t_{IGW_IN}$ is set (for example, 2.5 ms), and the energy input signal IGA is output after a predetermined waiting time $t_{wait}$.

Next, in step 109, it is determined whether the predetermined waiting time $t_{wait}$ has been reached. The waiting time $t_{wait}$ is separately generated by the $t_{wait}$ generation circuit 521 of the IGT generation circuit 52 as the time from the rise of the square wave signal 1*a*. When the answer is Yes in step 109, the process proceeds to step 110 to start the energy supply operation. The energy supply operation refers to the main ignition operation and the energy input operation, and both of them are carried out in the first embodiment.

Specifically, first, in step 111, it is determined whether the signal level of the square wave signal 1*a* is the H level, and the process proceeds to step 112 when the answer is Yes. In step 112, the gate signal IGBT_gate output from the main ignition drive circuit 31 is set to the H level to turn on the main ignition switch SW1.

As a result, as shown in FIG. 21, the main ignition signal IGT rises, energization of the primary coil 21 for the main ignition operation is started, and the primary current I1 flows.

When the answer is No in step 111, the process proceeds to step 116.

In step 113, it is determined whether the signal level of the square wave signal 1*a* is the L level, and the process proceeds to step 114 when the answer is Yes. In step 114, the gate signal IGBT_gate is set to the L level to turn off the main ignition switch SW1.

As a result, as shown in FIG. 21, the main ignition signal IGT falls (for example, after 4 ms from the rise) and the energization of the primary coil 21 is interrupted. Then, the high voltage generated in the secondary coil 22 causes the spark plug P to generate a spark discharge.

After that, in step 115, the energy input operation is performed. Specifically, the gate signals MOS_gate1 and MOS_gate2 for the energy input operation are output from the auxiliary primary coil control circuit 41 at a certain timing based on the target secondary current value I2*tgt* and the energy input period $t_{IGW}$ confirmed in steps 104 and 107 described above in order to drive the discharge continuation switch SW2 and the flyback switch SW3.

As a result, as shown in FIG. 21, the energy input operation is started after a predetermined delay period $t_{fil}$ (for example, 0.1 ms) from the fall of the main ignition signal IGT. The energy input operation is performed to maintain the target secondary current value I2*tgt* (for example, 90 mA) for the predetermined energy input period $t_{IGW}$ (for example, 2.5 ms), and the secondary current I2 and the current $I_{NET}$ flow.

After that, the process proceeds to step 116 to reset the energy input period $t_{IGW}$ and the target secondary current value I2*tgt* for the energy input operation. This iteration of the process then ends.

As a result, as shown in FIG. 21, the setting for the energy input operation is reset to the initial state after a predetermined reset period $t_{reswait}$ from the fall of the square wave signal 1*a* (for example, after 4 ms from the fall).

In this way, the main ignition signal IGT, the energy input signal IGW, and the target secondary current instruction signal IGA can be generated from the ignition control signal IG of the first embodiment, to perform the main ignition operation and the energy input operation.

In the case of the ignition control signal IG of the second embodiment, a fall of the square wave signal 1*a* is not detected in step 103 described above, and therefore the answer is No. In this case, the process proceeds to step 105 to determine whether the predetermined waiting time $t_{wait}$ has been reached. The actions taken in step 105 and the subsequent steps are substantially the same as those of step 109 and the subsequent steps described above, and when the answer is Yes in step 105, the process proceeds to step 117 to start the energy supply operation.

When the answer is No in step 105, the process returns to step 102 to repeat the actions of step 102 and the subsequent steps.

When the energy supply operation is to be started, specifically, first, in step 118, it is determined whether the signal level of the square wave signal 1*a* is the H level. When the answer is Yes, the process proceeds to step 119 to set the gate signal IGBT_gate to the H level and turn on the main ignition switch SW1.

When the answer is No in step 118, the process proceeds to step 122.

In step 120, it is determined whether the signal level of the square wave signal 1*a* is the L level. When the answer is Yes, the process proceeds to step 121 to set the gate signal IGBT_gate to the L level and turn off the main ignition switch SW1. As a result, the energization of the primary coil 21 is interrupted, and the high voltage generated in the secondary coil 22 causes the spark plug P to generate a spark discharge.

Since the energy input operation is not carried out after the main ignition operation in the second embodiment, the process then proceeds to step 122 to reset the energy input period $t_{IGW}$ and the target secondary current value I2*tgt* for the energy input operation after the reset period $t_{reswait}$ has passed from the fall of the square wave signal 1*a*. This iteration of the process then ends.

In this way, the main ignition signal IGT for the main ignition operation can be generated from the ignition control signal IG of the second embodiment.

In the case of the ignition control signal IG of the third embodiment [A], the second rise of the square wave signal 1*a* is not detected in step 106 described above, and therefore the answer is No. In this case, the process proceeds to step 108 to determine whether the predetermined waiting time $t_{wait}$ has been reached. The actions taken in step 108 and the subsequent steps are substantially the same as those of step 109 and the subsequent steps described above, and when the answer is Yes in step 108, the process proceeds to step 117 to start the energy supply operation. When the answer is No in step 108, the process returns to step 106 to repeat the actions of step 106 and the subsequent steps.

When the energy supply operation is started in step 117, in the subsequent step 118, it is determined whether the signal level of the square wave signal 1*a* is the H level.

In the case of the third embodiment [A], the answer of step 118 is No since the square wave signal 1*a* falls before the elapse of the waiting time $t_{wait}$. In this case, the process then proceeds to step 122 to reset the energy input period $t_{IGW}$ and the target secondary current value I2*tgt* for the energy input operation after the elapse of the reset period $t_{reswait}$ from the fall of the square wave signal 1*a*. This iteration of the process then ends.

Note that, since the square wave signal includes the first signal IG1 and the second signal IG2 in the case of the third embodiment [B], the second rise of the square wave signal 1*a* is detected in step 106 described above. In that case, the flow is similar to that of the first embodiment. The process proceeds to step 107, and the energy input period $t_{IGW}$ is confirmed based on the rising interval $t_{IGW_IN}$. After that, the process proceeds to step 109 to determine whether the predetermined waiting time $t_{wait}$ has been reached. When the answer is Yes in step 109, the process proceeds to step 110 to start the energy supply operation. When the answer is No in step 109, the process returns to step 106 to repeat the actions of step 106 and the subsequent steps.

When the energy supply operation is started in step 110, in the subsequent step 111, it is determined whether the signal level of the square wave signal 1*a* is the H level.

In the case of the third embodiment [B], the answer of step 111 is No since both the first signal IG1 and the second signal IG2 fall before the elapse of the waiting time $t_{wait}$. In this case, the process then proceeds to step 116 to reset the energy input period $t_{IGW}$ and the target secondary current value I2*tgt* for the energy input operation after the elapse of the reset period $t_{reswait}$ from the fall of the square wave signal 1*a*. This iteration of the process then ends.

As described above, in the cases of the ignition control signals IG of the third embodiment [A] and [B], the main ignition signal IGT is not generated by being separated by the signal separation circuit 5, and the main ignition operation and the energy input operation are not performed.

Sixth Embodiment

The sixth embodiment according to the ignition control device will be described with reference to FIGS. 22 to 29.

The present embodiment presents another configuration example of the IGT generation circuit 52 of the ignition device 10 of the ignition control device 1 according to the first embodiment for generating the main ignition signal IGT by separating it from the ignition control signal IG received by the signal separation circuit 5. In addition, other configuration examples of the IGW generation circuit 53 for generating the energy input signal IGW by separating it from the ignition control signal and the IGA generation circuit 54 for generating the target secondary current instruction signal IGA by separating it from the ignition control signal are presented.

Figure 22:
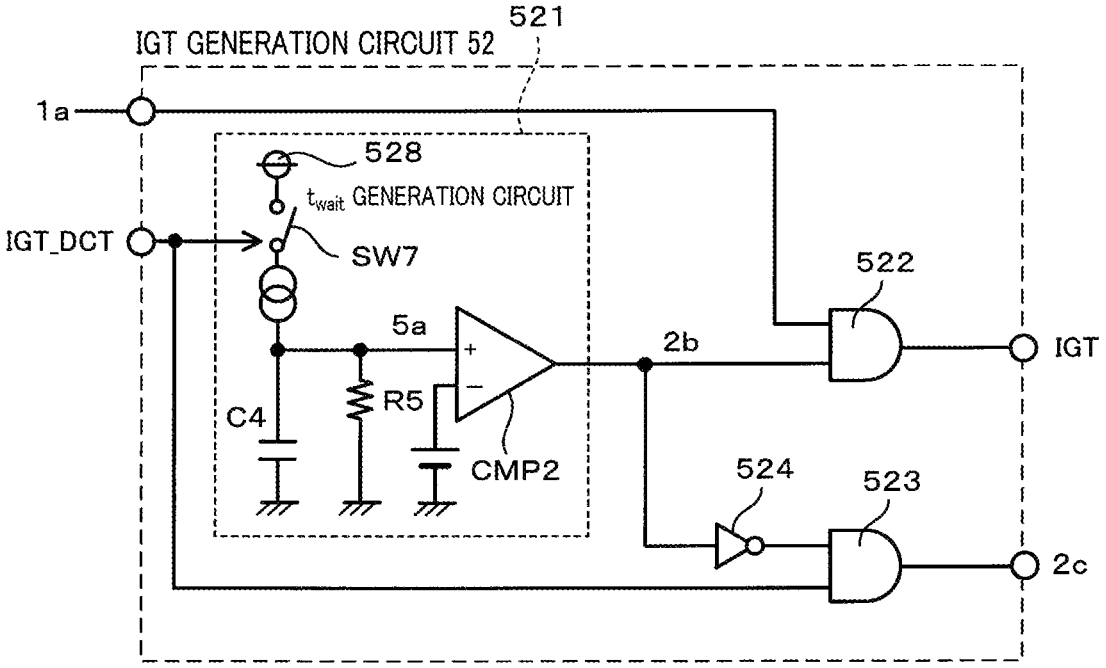
FIG. 22 is a circuit configuration diagram of an IGT generation circuit forming a part of the ignition device according to the sixth embodiment.

In FIG. 22, the IGT generation circuit 52 includes the $t_{wait}$ generation circuit 521 for generating the waiting time $t_{wait}$, the AND circuits 522, 523, and the inverter circuit 524. As with the first embodiment, the square wave signal 1*a* and the signal IGT_DCT are input from the waveform shaping circuit 51 to the IGT generation circuit 52, and the main ignition signal IGT and the signal 2*c* are generated based on the signal 2*b* output from the $t_{wait}$ generation circuit 521 and the square wave signal 1*a*.

In the first embodiment, as shown in FIG. 8, the $t_{wait}$ generation circuit 521 forming a part of the IGT generation circuit 52 is implemented as a digital circuit using a counter circuit. In this embodiment, as shown in the figure, it is implemented as an analog circuit including a constant current source 528, a capacitor C4, and a comparator CMP2. The constant current source 528 and the capacitor C4 are connected via a switch SW7, and a resistor R5 is provided in parallel with the capacitor C4. The switch SW7 is turned off in the initial state, and is turned on when the signal IGT_DCT is at the H level.

Figure 23:
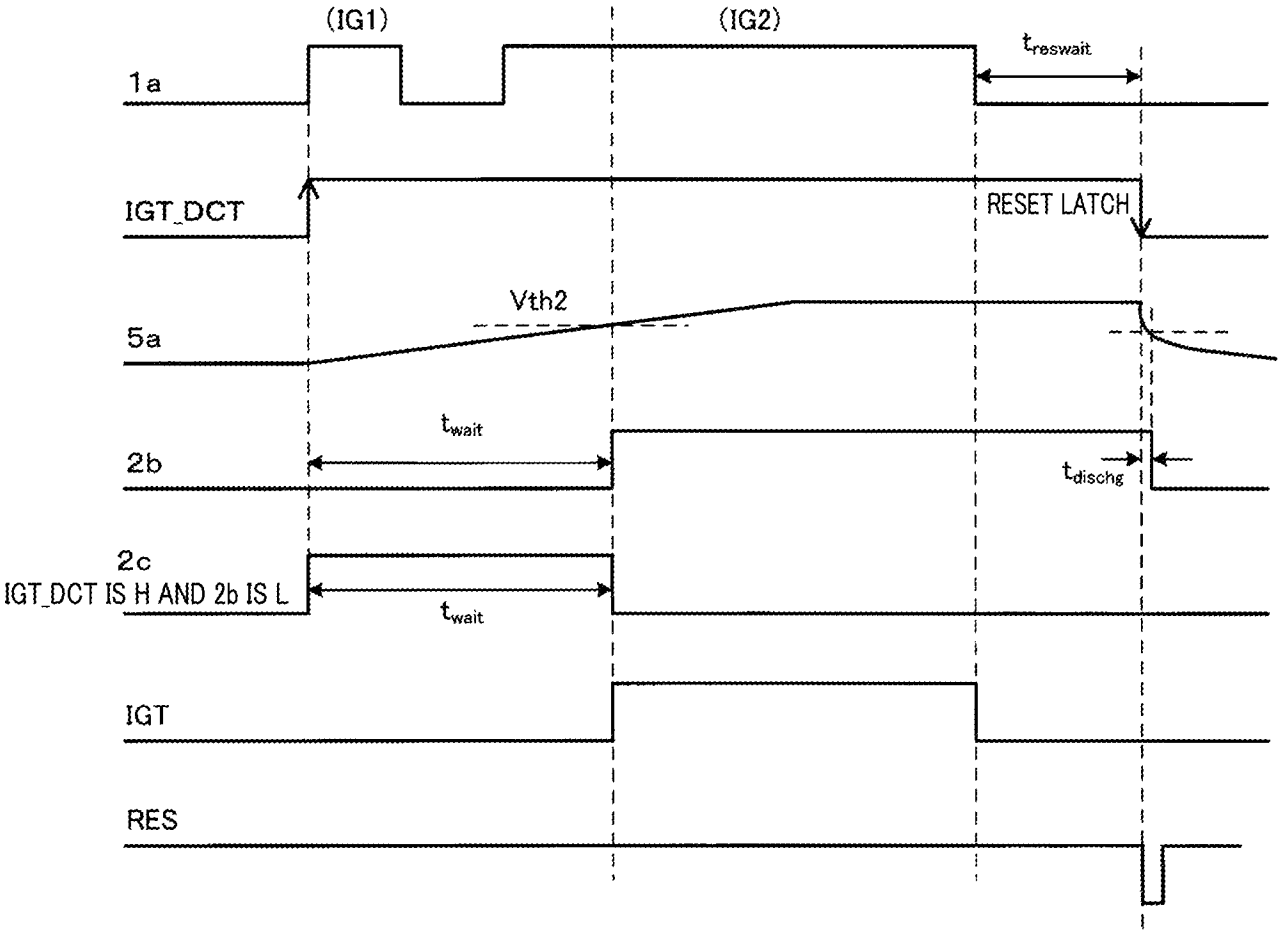
FIG. 23 is a timing chart diagram showing the relationship between the ignition control signal and the various signals generated in the IGT generation circuit according to the sixth embodiment.

As shown in FIG. 23, when the square wave signal 1*a* and the signal IGT_DCT from the waveform shaping circuit 51 rise, a constant current flows from the constant current source 528 to the capacitor C4, and the voltage signal 5*a* input to the positive terminal of the comparator CMP2 increases gradually. When the voltage of the capacitor C4 reaches the reference potential Vth2 input to the negative terminal of the comparator CMP2, the signal 2*b* output from the comparator CMP2 shifts to the H level.

The time from when the signal IGT_DCT reaches the H level until the signal 2*b* reaches the H level in the $t_{wait}$ generation circuit 521 corresponds to the predetermined waiting time $t_{wait}$. When the signal 2*b* reaches the H level after the waiting time $t_{wait}$, the output of the AND circuit 522 based on the logical sum of the signal 2*b* and the square wave signal 1*a* shifts to the H level. That is, the main ignition signal IGT can be set to the H level only when the square wave signal 1*a* is at the H level after the waiting time $t_{wait}$ has passed.

Note that an inverted signal of the signal 2*b* and the signal IGT_DCT are input to the AND circuit 523, and the signal 2*c* output based on the logical product of these signals is at the H level during the predetermined waiting time $t_{wait}$.

Figure 24:
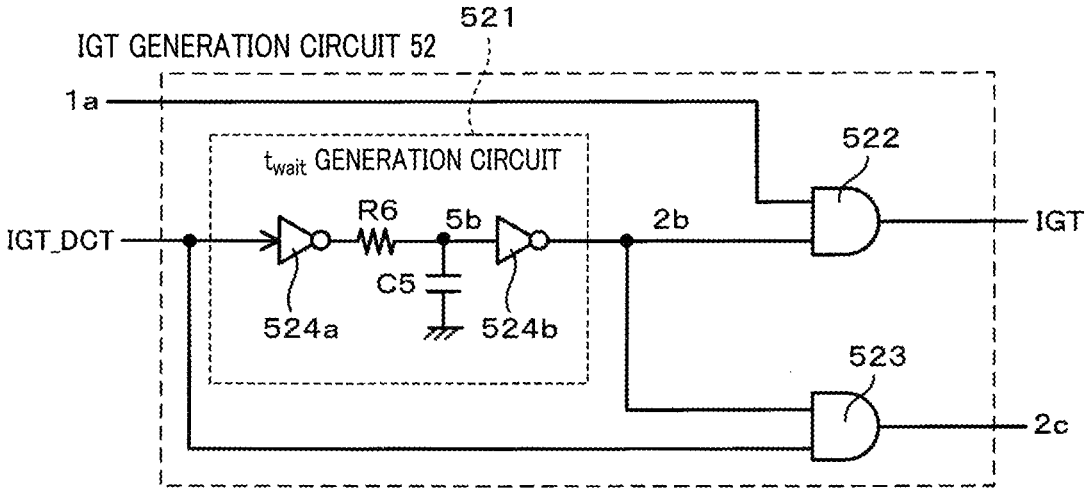
FIG. 24 is a circuit configuration diagram of the IGT generation circuit forming a part of the ignition device according to the sixth embodiment.

Alternatively, as shown in FIG. 24, the $t_{wait}$ generation circuit 521 of the IGT generation circuit 52 may be configured as a delay circuit including a plurality of inverter circuits 524*a*, 524*b* and a CR time constant circuit. The CR time constant circuit is a circuit that uses the time constant of the capacitor C5 and the resistor R6, and the inverter circuits 524*a*, 524*b* are connected to the input side and the output side of it, respectively.

Figure 25:
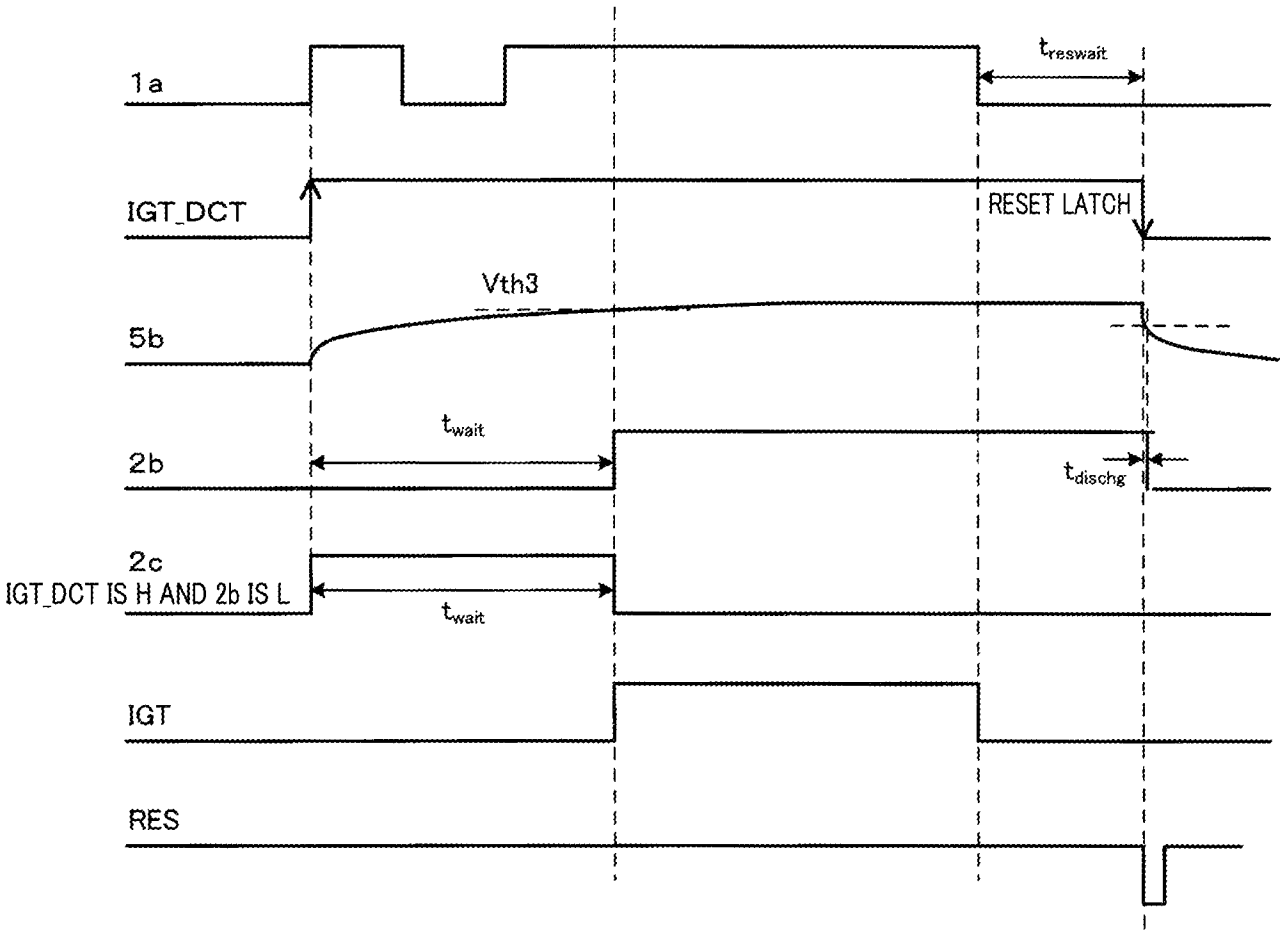
FIG. 25 is a timing chart diagram showing the relationship between the ignition control signal and the various signals generated in the IGT generation circuit according to the sixth embodiment.

In that case, as shown in FIG. 25, when the signal IGT_DCT from the waveform shaping circuit 51 rises, the $t_{wait}$ generation circuit 521 outputs a signal 5*b* having a delayed waveform. Since the signal 5*b* rises gradually, it takes some time to reach the reference potential Vth3, and the signal 2*b*, which is a signal inverted twice from the signal 5*b*, remains at the L level. When the reference potential Vth3 is reached, the signal 5*b* shifts to the H level, and the signal 2*b* also rises to the H level.

Therefore, it is also possible to output the main ignition signal IGT by making the delay time in the $t_{wait}$ generation circuit 521 correspond to the predetermined waiting time $t_{wait}$. In that case, since it is not necessary to use a comparator, reference voltage, a constant current source, and the like, the circuit configuration can be simplified.

Further, the waiting time $t_{wait}$ may be detected using the counter of the digital circuit.

Figure 26:
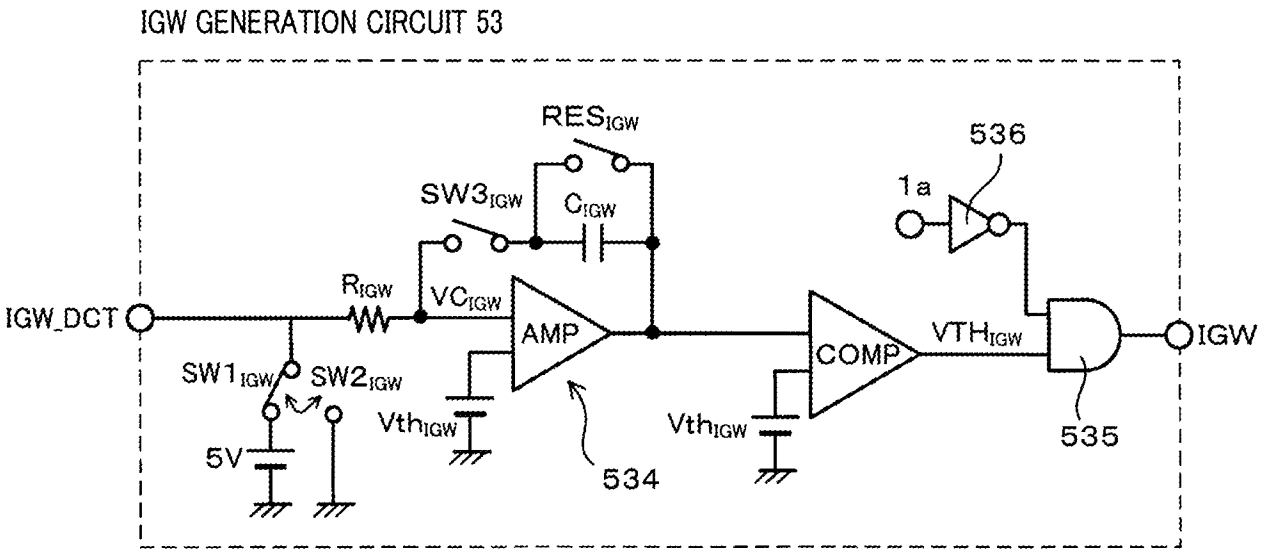
FIG. 26 is a circuit configuration diagram of the IGW generation circuit forming a part of the ignition device according to the sixth embodiment.

As shown in FIG. 26, the IGW generation circuit 53 may be implemented using an analog integrator circuit.

Specifically, the IGW generation circuit 53 includes an integrator circuit 534 including an operational amplifier AMP, a resistor $R_{IGW}$, and a capacitor $C_{IGW}$, a comparator COMP, an AND circuit 535, an inverter circuit 536, a plurality of switches $SW1_{IGW}$ to $SW3_{IGW}$, and a reset switch $RES_{IGW}$. The signal IGW_DCT is input to the integrator circuit 534 from the waveform shaping circuit 51, and the output from the integrator circuit 534 is input to one terminal of the AND circuit 535 via the comparator COMP. A signal obtained by inverting the square wave signal 1*a* from the waveform shaping circuit 51 via the inverter circuit 536 is input to the other terminal of the AND circuit 535.

The switch $SW1_{IGW}$ connected to a power supply (for example, 5V) and the switch $SW2_{IGW}$ connected to the ground potential are switchably connected (or connected in a mutually exclusive manner) to the input side of the integrating circuit 534, and the switch $SW3_{IGW}$ is interposed between the resistor $R_{IGW}$ and the capacitor $C_{IGW}$. The reset switch $RES_{IGW}$ is connected between the two terminals of the capacitor $C_{IGW}$.

Figure 27:
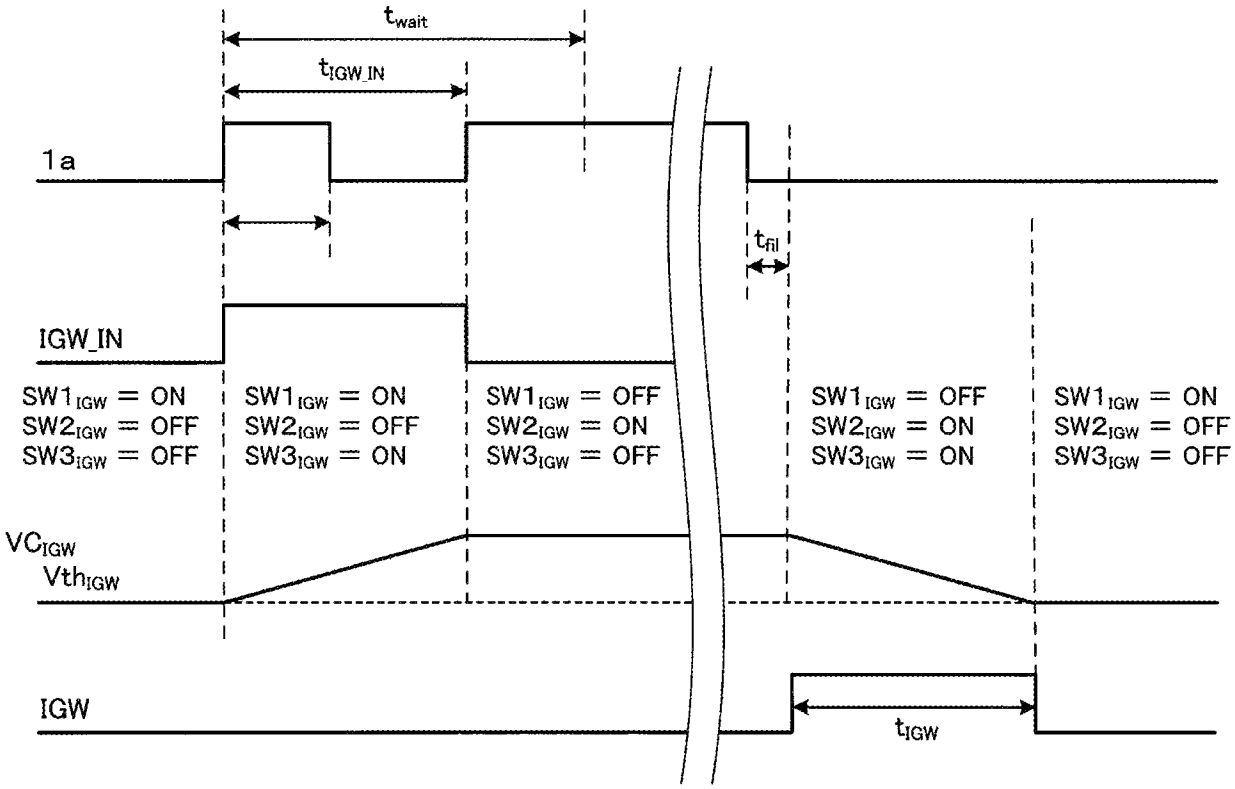
FIG. 27 is a timing chart diagram showing the relationship between the ignition control signal and the various signals generated in the IGW generation circuit according to the sixth embodiment.

As shown in FIG. 27, in the initial state, the switch $SW1_{IGW}$ is on and the switches $SW2_{IGW}$ and $SW3_{IGW}$ are off. Then, the switch $SW3_{IGW}$ is turned on when the rise of the signal IGW_DCT is detected. Energization of the capacitor $C_{IGW}$ starts, and the capacitor $C_{IGW}$ is charged while the signal IGW_DCT is at the H level. The charging time is converted to the voltage $VC_{IGW}$. After that, the switches $SW1_{IGW}$, $SW3_{IGW}$ are turned off when the second rise of the signal IGW_DCT is detected, and thus the voltage $VC_{IGW}$ of the capacitor $C_{IGW}$ is maintained. The switch $SW2_{IGW}$ is turned on to prepare for the discharging of the electric charge of the capacitor $C_{IGW}$.

During that time, an inverted signal of the square wave signal 1*a* is input to the AND circuit 535, but the input to the comparator COMP is below the reference voltage $Vth_{IGW}$ and the energy input signal IGW remains at the L level. Then, when the waiting time $t_{wait}$ generated by the IGT generation circuit 52 has passed and the square wave signal 1*a* is at the H level, the switch $SW3_{IGW}$ is turned on after a certain delay period $t_{fil}$ from the fall of the square wave signal 1*a* (the main ignition discharge) so that the charge of the capacitor $C_{IGW}$ is discharged.

As a result, the output from the comparator COMP increases and the output from the AND circuit 535 shifts to the H level. The voltage $VC_{IGW}$ of the capacitor $C_{IGW}$ gradually decreases over a discharge time corresponding to the charging time, and the energy input signal IGW having the H level is output with the energy input period $t_{IGW}$ being the period until the voltage falls below the reference voltage $Vth_{IGW}$. After that, the switches $SW1_{IGW}$ to $SW3_{IGW}$ return to the initial state.

Figure 28:
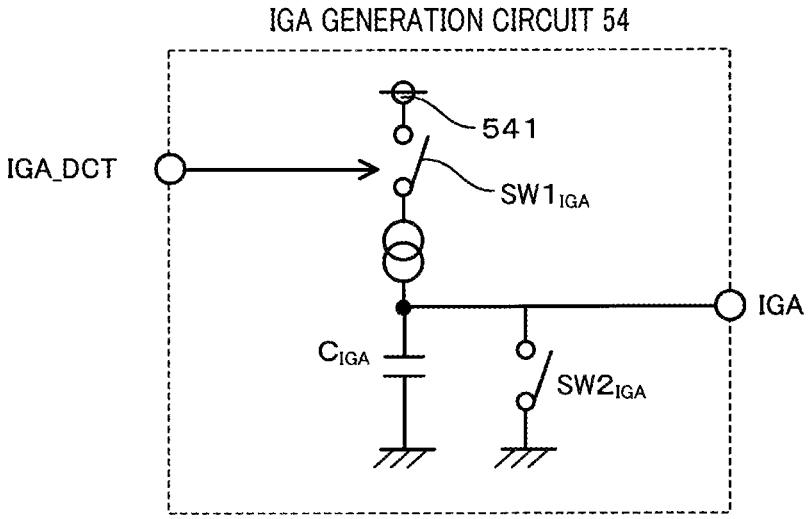
FIG. 28 is a timing chart diagram showing the relationship between the signals generated in the IGA generation circuit forming a part of the ignition device and various signals according to the sixth embodiment.

As shown in FIG. 28, the IGA generation circuit 54 may be implemented as an analog circuit. Specifically, instead of using the up counter circuit as in the first embodiment, the IGA generation circuit 54 uses a constant current source 541 and a capacitor $C_{IGA}$ to detect, from the signal IGA_DCT based on the square wave signal 1*a*, the rising period $t_{IGA_IN}$ thereof. The constant current source 541 and the capacitor $C_{IGA}$ are connected via a switch $SW1_{IGA}$, and a switch $SW2_{IGA}$ is provided in parallel with the capacitor $C_{IGA}$.

Figure 29:
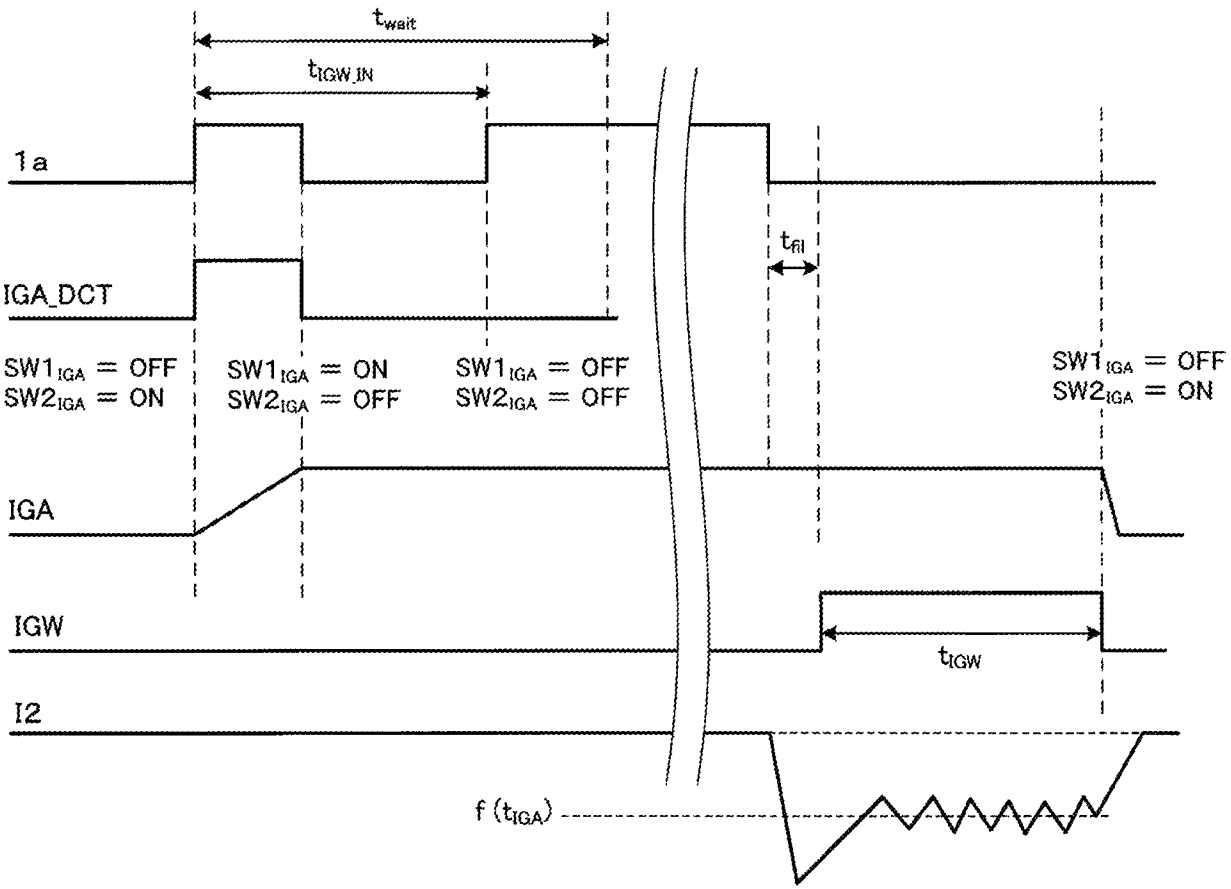
FIG. 29 is a timing chart diagram showing the relationship between the signals generated in the IGA generation circuit forming a part of the ignition device and various signals according to the sixth embodiment.

As shown in FIG. 29, in the initial state, the switch $SW1_{IGA}$ is off and the switch $SW2_{IGA}$ is on. Then, the switch $SW1_{IGA}$ is turned on and the switch $SW2_{IGA}$ is turned off when the rise of the signal IGA_DCT is detected. The capacitor $C_{IGA}$ is charged while the signal IGA_DCT is at the H level, and the target secondary current instruction signal IGA increases. When the signal IGA_DCT shifts to the L level, the switches $SW1_{IGA}$, $SW2_{IGA}$ are turned off so that the target secondary current instruction signal IGA is maintained.

After that, when the waiting time $t_{wait}$ generated by the IGT generation circuit 52 has passed and the square wave signal 1*a* is at the H level, the main ignition discharge is performed at the time the square wave signal 1*a* falls, and after a further delay time $t_{fil}$, the energy input signal IGW rises. As a result, the energy input operation is performed based on the target secondary current instruction signal IGA during the energy input period $t_{IGW}$. As with Table 1 of the first embodiment, the target secondary current instruction signal IGA is set so that, for example, the larger the voltage value, the larger the target secondary current value I2*tgt*. When the energy input signal IGW falls, the switches $SW1_{IGA}$, $SW2_{IGA}$ return to the initial state.

As described above, the IGT generation circuit 52, the IGW generation circuit 53, and the IGA generation circuit 54 can have various configurations implemented using a digital circuit or an analog circuit.

Seventh Embodiment

Figure 30:
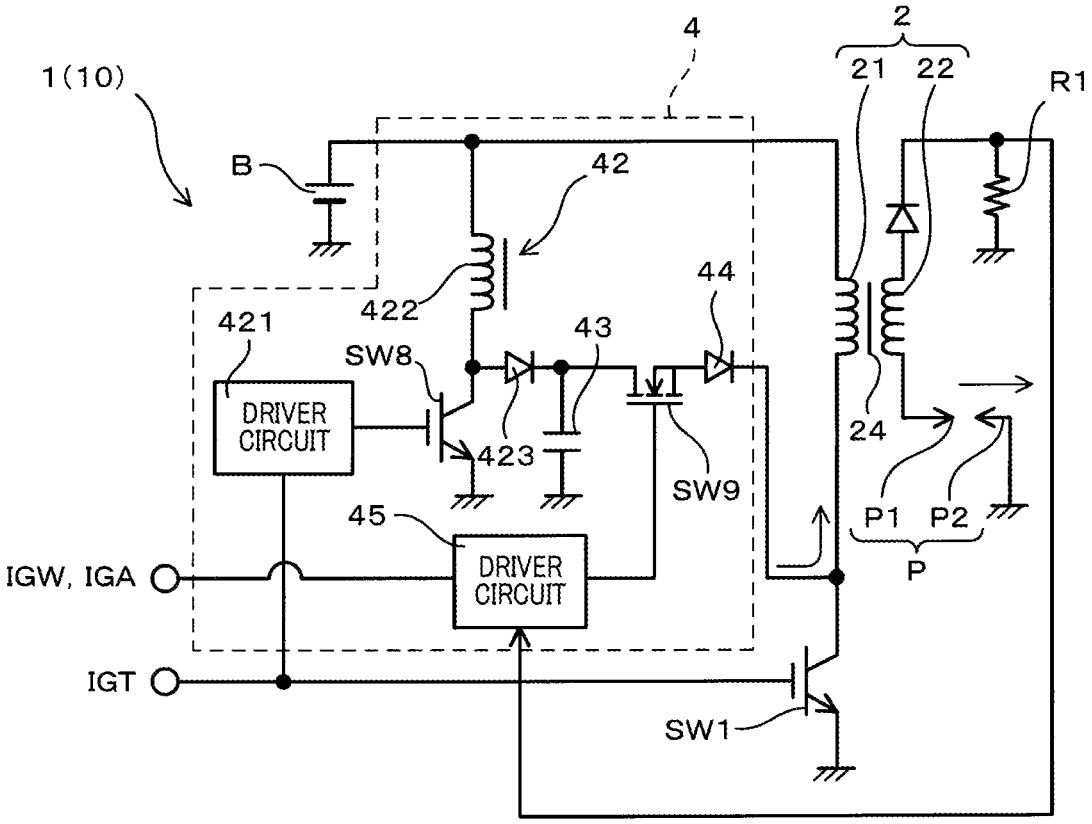
FIG. 30 is a circuit configuration diagram of an ignition control device according to the seventh embodiment.

The seventh embodiment according to the ignition control device will be described with reference to FIG. 30.

In the above embodiment, the primary coil 21 of the ignition coil 2 is composed of the main primary coil 21*a* and the auxiliary primary coil 21*b*, and it is connected in parallel with the DC power source B. Alternatively, as shown in FIG. 30, the ignition coil 2 may be composed of the primary coil 21 and the secondary coil 22. Further, the energy input circuit unit 4 may be provided with a booster circuit 42 and a capacitor 43 so that the energy stored in the capacitor 43 is supplied to the ground side of the primary coil 21 in a superimposed manner.

In the present embodiment, the booster circuit 42 includes a switching element for boosting (hereinafter referred to as a boost switch) SW8, a boost driver circuit 421 for driving the boost switch SW8, a choke coil 422, and a diode 423. The boost driver circuit 421 switches the boost switch SW8 to store the energy generated in the choke coil 422 in the capacitor 43. A discharge continuation switch SW9 is connected between the primary coil 21 and the main ignition switch SW1 via the diode 44, and is driven by an energy input driver circuit 45. The forward direction of the diode 423 is the direction toward the capacitor 43, and the forward direction of the diode 44 is the direction toward the primary coil 21.

The boost driver circuit 421 is driven based on the main ignition signal IGT and charges the capacitor 43 during the main ignition operation. The energy input driver circuit 45 drives the discharge continuation switch SW9 in the energy input period $t_{IGW}$ after the main ignition operation based on the target secondary current instruction signal IGA and the energy input signal IGW so as to input the energy stored in the capacitor 43 to the ground side of the primary coil 21 in a superimposed manner. Such a configuration is also capable of making the spark discharge continue by carrying out the energy input operation by increasing a current having the same polarity as the secondary current I2.

The configurations of the ignition coil 2 and the energy input circuit unit 4 can be changed as appropriate as with these examples. For example, the booster circuit 42 of the seventh embodiment may be provided in the configuration of the first embodiment to supply electricity from the booster circuit 42 to the auxiliary primary coil 21*b* to perform the energy input operation. Further, more than one, for example, two ignition coil 2 pairs, each composed of a primary coil 21 and a secondary coil 22, may be provided, and one of the ignition coils 2 may perform the main ignition operation whereas the other ignition coil 2 is used to perform the energy input operation.

The present disclosure is not limited to the above embodiments, and can be applied to various embodiments without departing from the gist of the present disclosure. For example, the ignition control signal IG has been described as a positive logic signal whose logic level is "1" when the signal voltage is at the H level, but it may be a negative logic signal that has a logic level opposite to the potential. The same applies to signals other than the ignition control signal IG, and it can be set as appropriate.

The internal combustion engine to which the ignition control device 1 is applied may be a gasoline engine for automobiles or any of various spark-ignition internal combustion engines. The configurations of the ignition coil 2 and the ignition device 10 may be appropriately changed according to the internal combustion engine to which they are applied, as long as they can perform the energy input operation after the main ignition operation. For example, two ignition coil 2 pairs may be provided in such a manner that the secondary coils 22 are connected in series, and the secondary current generated in one of the two secondary coils can be supplied to the other.

What is claimed is:

1. An ignition control device comprising:

an ignition coil which generates discharge energy in a secondary coil connected to a spark plug by increasing and decreasing a primary current flowing through a primary coil;

a main ignition circuit unit which controls energization of the primary coil to perform a main ignition operation for causing the spark plug to generate a spark discharge; and an energy input circuit unit which performs an energy input operation for superimposing a current of the same polarity on a secondary current caused to flow through the secondary coil by the main ignition operation, wherein the ignition control device further comprises a signal separation circuit unit which receives an ignition control signal which is a signal combining a main ignition signal for controlling the main ignition operation, an energy input signal for controlling the energy input operation, and a target secondary current instruction signal, and separates one or more signals included in the received ignition control signal, the ignition control signal includes a first pulse signal and a second pulse signal, and is transmitted prior to the main ignition operation, the signal separation circuit unit includes a main ignition signal generation circuit which generates the main ignition signal such that a point in time when a waiting time has passed from a detection start time of the first pulse signal at which a signal level of the ignition control signal changed from a first level to a second level for the first time, and the signal level of the ignition control signal is the second level, is a start of the main ignition signal, and a detection end time of the second pulse signal at which the signal level of the ignition control signal shifts to the first level thereafter is an end of the main ignition signal, and the main ignition circuit unit energizes the primary coil at the start of the main ignition signal and cuts off the energization of the primary coil at the end of the main ignition signal.

2. The ignition control device according to claim 1, wherein the signal separation circuit unit includes a waveform shaping circuit which shapes a waveform of the ignition control signal and outputs a square wave signal including the first pulse signal and the second pulse signal, and the square wave signal is input to the main ignition signal generation circuit and a reset signal generation circuit which outputs a reset signal to the main ignition signal generation circuit, and the reset signal generation circuit resets the main ignition signal generation circuit to an initial state when a predetermined period passes after the second change of the square wave signal from the second level to the first level.

3. The ignition control device according to claim 2, wherein the main ignition signal generation circuit includes a waiting time generation circuit which, based on a signal level of the square wave signal, detects a time that has passed from a point in time at which detection of the first pulse signal started in response to a change from the first level to the second level, and outputs a signal when the waiting time is reached.

4. The ignition control device according to claim 1, wherein the signal separation circuit unit generates the energy input signal based on pulse waveform information of the first pulse signal and the second pulse signal, and the target secondary current instruction signal based on pulse waveform information of the first pulse signal.

5. The ignition control device according to claim 4, wherein the signal separation circuit unit includes an energy input signal generation circuit which generates the energy input signal based on a detection interval of the first pulse signal and the second pulse signal, and a target secondary current instruction signal generation circuit which generates the target secondary current instruction signal based on a detection period of the first pulse signal.

6. The ignition control device according to claim 4, wherein, when the energy input signal is generated in the signal separation circuit unit, a reset period which is longer than an energy input period corresponding to the energy input signal is set after interruption of the energization of the primary coil, and when the energy input signal is not generated, the reset period is not set.

7. The ignition control device according to claim 1, wherein the primary coil includes a main primary coil and an auxiliary primary coil, and the energy input circuit unit controls the energy input operation by controlling energization of the auxiliary primary coil.

8. The ignition control device according to claim 1, further comprising a feedback control unit which feedback-controls the secondary current based on the target secondary current instruction signal.

9. The ignition control device according to claim 1, further comprising an ignition control signal transmission unit which generates and transmits the ignition control signal at a timing earlier than start of the main ignition operation for a respectively corresponding cylinder by the waiting time.

10. The ignition control device according to claim 1, wherein the spark plug is for an internal combustion engine, and the waiting time is variably set according to an operating condition of the internal combustion engine.

* * * * *